US008175471B2

(12) United States Patent
Tomita et al.

(10) Patent No.: US 8,175,471 B2
(45) Date of Patent: May 8, 2012

(54) IMAGE FORMING APPARATUS AND IMAGE DENSITY CONTROL METHOD

(75) Inventors: Kentaroh Tomita, Kanagawa (JP); Nobutaka Takeuchi, Kanagawa (JP); Hitoshi Ishibashi, Kanagawa (JP); Shin Hasegawa, Kanagawa (JP); Shinji Kato, Kanagawa (JP); Kohta Fujimori, Kanagawa (JP); Kayoko Tanaka, Tokyo (JP); Yushi Hirayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 618 days.

(21) Appl. No.: 11/952,553

(22) Filed: Dec. 7, 2007

(65) Prior Publication Data

US 2008/0145078 A1 Jun. 19, 2008

(30) Foreign Application Priority Data

Dec. 15, 2006 (JP) ..... 2006-338006

(51) Int. Cl.
*G03G 15/08* (2006.01)

(52) U.S. Cl. ..... 399/30; 399/27; 399/49

(58) Field of Classification Search ..... 399/30, 399/50

See application file for complete search history.

(56) References Cited

U.S. PATENT DOCUMENTS

| | | | | |
|---|---|---|---|---|
| 5,198,861 | A | 3/1993 | Hasegawa et al. | |
| 5,327,196 | A | 7/1994 | Kato et al. | |
| 5,387,965 | A | 2/1995 | Hasegawa et al. | |
| 5,475,476 | A | 12/1995 | Murai et al. | |
| 5,508,787 | A | 4/1996 | Hasegawa et al. | |
| 5,860,038 | A | 1/1999 | Kato et al. | |
| 5,970,276 | A | 10/1999 | Kato | |
| 6,081,678 | A | 6/2000 | Kato | |
| 6,147,698 | A * | 11/2000 | Zable et al. | 347/240 |
| 6,418,281 | B1 * | 7/2002 | Ohki | 399/49 |
| 6,526,235 | B2 | 2/2003 | Kato | |
| 6,594,453 | B2 | 7/2003 | Kato | |
| 7,055,928 | B2 | 6/2006 | Ishibashi et al. | |

(Continued)

FOREIGN PATENT DOCUMENTS

JP 57-136667 8/1982

(Continued)

OTHER PUBLICATIONS

U.S. Appl. No. 12/112,525, filed Apr. 30, 2008, Koizumi, et al.

(Continued)

*Primary Examiner* — David Gray
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus is disclosed that includes an image density control unit that performs control operations based on an image density control condition that is adjustably set to control an output image to have a predetermined image density, an image density control condition modifying unit that calculates a modified image density control condition based on information on an amount of toner exchanged at a developing apparatus within a predetermined period and a parameter for image density control condition calculation and sets the modified image density control condition as the image density control condition to be used by the image density control unit, and a parameter modifying unit that modifies the parameter for image density control condition calculation used by the image density control condition modifying unit based on a toner pattern detection result obtained by detecting a toner pattern formed on a belt member.

19 Claims, 12 Drawing Sheets

U.S. PATENT DOCUMENTS

| | | | | |
|---|---|---|---|---|
| 7,139,511 | B2 | 11/2006 | Ishibashi | |
| 7,190,912 | B2 | 3/2007 | Kato | |
| 7,203,433 | B2 | 4/2007 | Kato et al. | |
| 7,251,420 | B2 | 7/2007 | Fujimori et al. | |
| 7,260,335 | B2 | 8/2007 | Kato et al. | |
| 7,305,195 | B2 | 12/2007 | Ishibashi | |
| 2003/0210412 | A1 | 11/2003 | Ishibashi | |
| 2004/0251435 | A1 | 12/2004 | Sawayama et al. | |
| 2005/0058464 | A1* | 3/2005 | Azami et al. | 399/30 |
| 2005/0089340 | A1* | 4/2005 | Yamamoto | 399/49 |
| 2006/0222419 | A1 | 10/2006 | Ishibashi et al. | |
| 2006/0239705 | A1 | 10/2006 | Ishibashi | |
| 2006/0274628 | A1 | 12/2006 | Tanaka et al. | |
| 2007/0025748 | A1 | 2/2007 | Ishibashi et al. | |
| 2007/0036566 | A1 | 2/2007 | Takeuchi et al. | |
| 2007/0053703 | A1 | 3/2007 | Hirayama | |
| 2007/0065164 | A1 | 3/2007 | Fujimori et al. | |
| 2007/0110455 | A1* | 5/2007 | Ariizumi et al. | 399/27 |
| 2007/0147854 | A1* | 6/2007 | Yamada | 399/12 |

FOREIGN PATENT DOCUMENTS

| | | |
|---|---|---|
| JP | 2-34877 | 2/1990 |
| JP | 3-251878 | 11/1991 |
| JP | 7-234582 | 9/1995 |
| JP | 9-15961 | 1/1997 |
| JP | 2000-214672 | 8/2000 |
| JP | 2002-40794 | 2/2002 |
| JP | 2003-177580 | 6/2003 |
| JP | 2005-134796 | 5/2005 |
| JP | 2006-91094 | 4/2006 |
| JP | 2006-119306 | 5/2006 |
| JP | 2007-133235 | 5/2007 |

OTHER PUBLICATIONS

Office Action issued Apr. 22, 2011 in Japanese Patent Application No. 2006-338006.

* cited by examiner

IMAGE FORMING APPARATUS AND IMAGE DENSITY CONTROL METHOD

BACKGROUND OF THE INVENTION

1. Field of the Invention

The present invention relates to an image forming apparatus such as a copier, a printer, or a facsimile machine that forms an image using a two component developer made up of toner and a magnetic carrier, and an image density control method.

2. Description of the Related Art

The two component development system is a conventionally known technique that involves supporting a two component developer made of toner and a magnetic carrier (simply referred to as 'developer' hereinafter) on a developer carrier, forming a magnetic brush with the magnetic developer by the magnetic pole provided within the developer carrier, and developing a latent image on a latent image carrier with the magnetic brush. The two component development system is widely used since it enables color imaging with relative ease.

It is noted that in forming an image, an image forming apparatus has to maintain a constant image density. The image density is determined primarily by the developing capacity of a developing apparatus. The developing capacity represents the amount of toner adhered to a latent image in the development process. The developing capacity may vary depending on the toner density of the developer contained in the developing apparatus, developing conditions such as the developing potential representing the potential difference between the latent image formed on the surface of the latent image carrier and the developer carrier surface on which a developing bias is applied, and the amount of charge of the toner used for image development for example. Accordingly, a typical image forming apparatus is configured to control image density control conditions such as toner density, writing light, and developing bias in order to maintain a constant image density. For example, the toner density of the developer within the developing apparatus may be controlled by controlling toner supply operations based on an output value of a toner density detecting unit that detects and outputs the toner density so that the toner density of the developer may be equal to a toner density control reference value. Also, the developing potential may be controlled by obtaining a suitable developing potential for maintaining a constant image density based on the slope of a relational expression representing the toner adhering amount in relation to the developing potential ($\gamma$ development) and controlling the writing light and the developing bias so that the developing potential may be equal to the suitable developing potential.

As can be appreciated, it is relatively easy to control image density control conditions such as toner density and developing potential (writing light and developing bias) may be controlled to predetermined target values for obtaining a desired image density. However, it is relatively difficult to control the amount of charge of the toner used in the image development to a predetermined target value for obtaining a desired image density. As a consequence, stable developing capacity may not be achieved even if the developing potential and the toner density may be maintained constant and in turn, a desired image density may not be obtained.

Specifically, for example, in the case of outputting an image with a low image area ratio, the amount of toner consumed upon developing such an image may be relatively small so that the amount of toner to be supplied to maintain the toner density to a desired density level may be relatively small. In this case, toner is likely to reside within the developing apparatus for a relatively long time. Toner residing within the developing apparatus for a relatively long time may be stirred for a long time so that a large portion of the toner used in image development may have a charge that is greater than the desired charge. In turn, a strong electrostatic force may be required for separating the toner from the carrier so that the developing capacity may be degraded. On the other hand, in the case of outputting an image with a high image area ratio, a large portion of the toner residing within the developing apparatus may be new toner that has just been supplied and is not yet adequately charged so that a large portion of the toner used in image development may not be charged to the desired charge level. In this case, the electrostatic force required for separating the toner from the carrier may be relatively weak so that the developing capacity may be relatively high. With the growing demand for miniaturization of the developing apparatus, the amount of developer contained within the developing apparatus is being reduced. In turn, there is a growing number of instances in which toner used for image development is not adequately charged to the desired charge level during image formation performed after outputting an image with a high image area ratio. Therefore, the developing capacity during image formation performed after outputting an image with a high image area ratio tends to be relatively high.

As can be appreciated, the proportional amount of newly supplied toner residing within the development apparatus after image output may vary depending on whether an image with a low image area ratio is successively output or an image with a high image area ratio is successively output, for example. In turn, differences are created in the developing capacity. That is, the developing capacity cannot be maintained constant even when the developing potential and the toner density are maintained constant so that a fixed image density cannot be achieved.

It is noted that an image forming apparatus that is configured to counter such a problem is disclosed in Japanese Laid-Open Patent Publication No. 57-136667 and Japanese Laid-Open Patent Publication No. 2-34877, for example. Such an image forming apparatus includes toner density detection means for detecting and outputting the toner density of a two component developer within a developing apparatus corresponding to an image density control condition and is configured to compare the output value of the toner density detection means with a toner density control reference value, control operations of a toner supply apparatus based on the comparison result, and control the toner density of the two component toner within the developing apparatus to a desired toner density. The image forming apparatus is also configured to detect the density of a reference toner pattern formed at a non-image region to determine the image density obtained at the time of forming the reference toner pattern and correct the toner density control reference value based on the detection result. By implementing such a technique, image formation with the desired image density may be enabled for some time after such correction is performed. That is, by periodically forming a reference toner pattern and correcting the toner density control reference value according to detection results of the reference toner pattern, a fixed image density may be achieved.

However, in the image forming apparatus according to Japanese Laid-Open Patent Publication No. 57-136667 or Japanese Laid-Open Patent Publication No. 2-34877, a reference toner pattern has to be formed each time the toner density control reference value is to be corrected. Therefore, the amount of toner consumed for operations other than image formation may be increased.

In view of such a problem, the inventors of the present invention has previously disclosed an image forming apparatus as is described in Japanese Laid-Open Patent Publication No. 2007-133235. Specifically, the image forming apparatus according to this disclosure includes information detection means for detecting information for determining the amount of toner exchanged at the developing apparatus within a predetermined period of time such as the image area ratio of an image output during this time period. In this way, the proportional amount of newly supplied toner and/or the proportional amount of old toner residing within the developing apparatus may be determined based on the detection result obtained by the information detection means so that the developing capacity of the developing apparatus may be determined. In turn, the toner density control reference value may be corrected by toner density control reference value correction means based on the detection result of the information detection means so that the toner density within the developing apparatus may be adjusted and a constant image density may be obtained. It is noted that the information on the toner exchange amount used for correcting the toner density control reference value in the above-described image forming apparatus may be detected without consuming toner unlike the case of detecting the image area ratio of an output image. Therefore, the amount of toner consumed for operations other than image formation may be prevented from increasing.

However, the image forming apparatus according to Japanese Laid-Open Patent Publication No. 2007-133235 does not have measures for responding to factors other than the amount of toner exchanged at the developing apparatus within a predetermined period of time. For example, the above-described apparatus is not configured to respond to fluctuations in the developing capacity of the developing apparatus due to environmental change or variations in standby time so that image density may still not be adequately controlled.

It is noted that occurrence of the above-described problems is not limited to the case of correcting the toner density control reference value for the toner density as the image density control condition based on the toner exchange amount information. For example, similar problems may occur in a case where the control reference values for toner density and developing bias as image density control conditions are fixed while a control reference value for the writing light as another image density control condition is corrected based on the toner exchange amount information. Also, similar problems may occur in a case where the control reference values for toner density and writing light as image density control conditions are fixed while a control reference value for the developing bias as another image density control condition is corrected based on the toner exchange amount information.

SUMMARY OF THE INVENTION

Aspects of the present invention are directed to providing an image forming apparatus and an image density control method adapted for reducing the consumption amount of toner used for operations other than image formation while maintaining a fixed image density by adequately responding to changes in the developing capacity of a developing apparatus caused by environmental change, for example.

According to one embodiment of the present invention, an image forming apparatus is provided that includes:

an image carrier that supports a latent image;

a latent image forming unit that forms a latent image on the image carrier;

a developing apparatus that develops the latent image formed on the latent image carrier into a toner image using a developer including toner and a magnetic carrier;

an image density control unit that performs control operations based on an image density control condition that is adjustably set to control an output image to have a predetermined image density;

a belt member that is arranged to be in contact with the image carrier and is suspended in a tensioned state by a plurality of support members;

a toner pattern detection unit that detects a toner pattern formed on the belt member;

an information detection unit that detects information for determining an amount of toner exchanged at the developing apparatus within a predetermined period;

an image density control condition modifying unit that calculates a modified image density control condition based on the information detected by the information detection unit and a parameter used for image density control condition calculation and sets the modified image density control condition as the image density control condition to be used by the image density control unit; and a parameter modifying unit that modifies the parameter used for image density control condition calculation based on a detection result obtained by the toner pattern detection unit.

According to another embodiment of the present invention, an image density control method is provided that is implemented in an image forming apparatus including an image carrier that supports a latent image, a latent image forming unit that forms the latent image on the image carrier, a developing apparatus that develops the latent image formed on the latent image carrier into a toner image using a developer including toner and a magnetic carrier, and a belt member that is arranged to be in contact with the image carrier and is suspended in a tensioned state by a plurality of support members, the method including the steps of:

modifying an image density control condition based on information for determining an amount of toner exchanged at the developing apparatus within a predetermined period and a parameter that is adjustably set according to a detection result obtained by detecting a toner pattern that is formed on the belt member; and controlling an image density of an output image based on the modified image density control condition.

DESCRIPTION OF THE PREFERRED EMBODIMENTS

Figure 1:
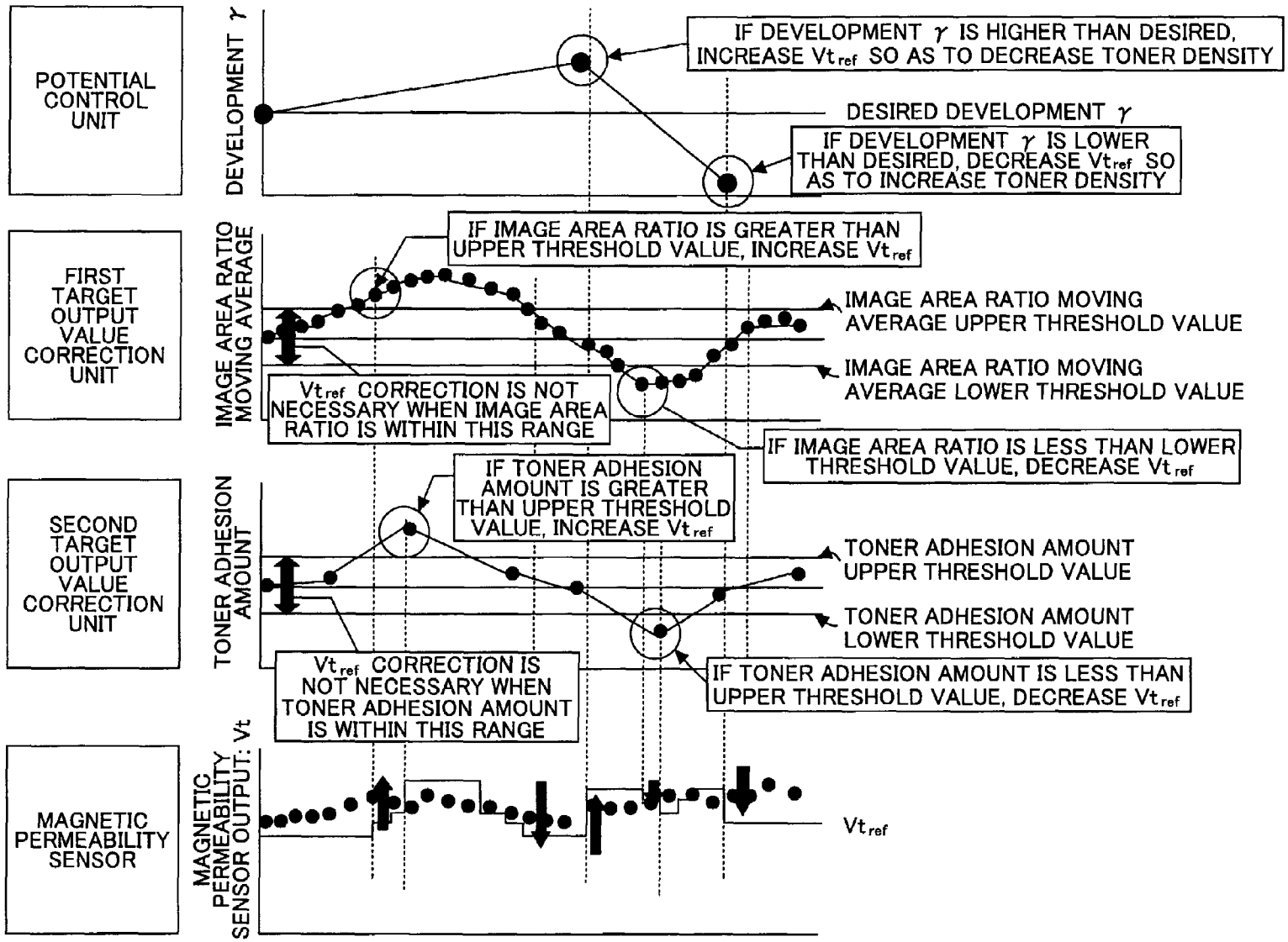
FIG. 1 is a diagram illustrating control operations of a target output value correction process according to an embodiment of the present invention.

As is described above, differences in the image density of images output by an image forming apparatus may occur as a result of differences in the proportion of newly supplied toner or old toner within a developing apparatus that may create differences in the developing capacity. Thus, according to an embodiment of the present invention, information for determining the amount of toner exchanged at the developing apparatus within a predetermined period is detected. In this way, the amount of toner consumed at the developing apparatus and the amount of new toner supplied to the developing apparatus within a predetermined period may be determined based on the detected information. In other words, the proportional amount of new toner or old toner contained in the developing apparatus may be determined based on the detected information, and in turn, the developing capacity of the developing apparatus may be determined. Accordingly, based on the detected information, an image density control condition may be corrected as is necessary by an image density control condition modifying unit to maintain the developing capacity of the developing apparatus at a fixed level. Thus, even when the amount of toner exchanged at the developing apparatus fluctuates in image forming operations, by adjusting the image density control condition, the developing capacity of the developing apparatus may be maintained at a fixed level and the image density of output images may be maintained at a fixed level. It is noted that since the information for determining the amount of toner exchanged at the developing apparatus may be detected without consuming toner, the image density control condition modifying unit may modify the image density control condition without consuming toner.

Also, according to an embodiment of the present invention, even when the developing capacity of the developing apparatus changes due to external factors such as environmental change or time lapse, an image density of a toner pattern formed on a belt member may be detected, and, based on this detection result, a parameter modifying unit may correct a parameter used by the image density control condition modifying unit for calculating a suitable image density control condition for maintaining the developing capacity of the developing apparatus to a fixed level. In this way, influences of changes in the developing capacity of the developing apparatus caused by external factors such as environmental change or time lapse may be reflected in the image density control condition calculation by the image density control condition modifying unit. That is, the image density control condition modifying unit may be capable of adequately responding to changes in the developing capacity caused by factors other than a change in the amount of toner exchanged at the developing apparatus. Accordingly, the image density control condition modifying unit may be used to modify the image density control condition as is necessary to maintain the developing capacity of the developing apparatus to a fixed level so that the image density of output imaged may be maintained at a fixed level. It is noted that since a change in the developing capacity due to environmental change or time lapse does not occur all of a sudden, the parameter modifying process by the parameter modifying unit may not have to be performed as frequently as the image density control condition modifying process by the image density control condition modifying unit. That is, the parameter modifying unit may be capable of adequately responding to a change in the developing capacity due to external factors such as environmental change or time lapse even in such a case. Thus, according to an embodiment of the present invention, by using information for determining the amount of toner exchanged at the developing apparatus in combination with toner pattern detection results to maintain the image density of output images at a fixed level, toner pattern detection processes for maintaining the image density of output images to a fixed level may be performed less frequently compared to conventional applications that rely solely on toner pattern detection results to maintain the image density of output images to a fixed level so that the toner consumption amount may be reduced in the present embodiment, for example.

As can be appreciated from the above descriptions, according to an aspect of the present invention, a desired image density may be obtained while reducing the amount of toner consumption for operations other than image forming operations and adequately responding to changes in the developing capacity of the developing apparatus due to external factors such as environmental change.

In the following, preferred embodiments of the present invention are described with reference to the accompanying drawings.

FIG. 1 is a diagram illustrating overall control operations of a target output value correction process according to an embodiment of the present invention, the details of which are described below.

In the following, an electrophotographic color laser printer (simply referred to as 'laser printer' hereinafter) as an image forming apparatus according to an embodiment of the present invention is described.

Figure 2:
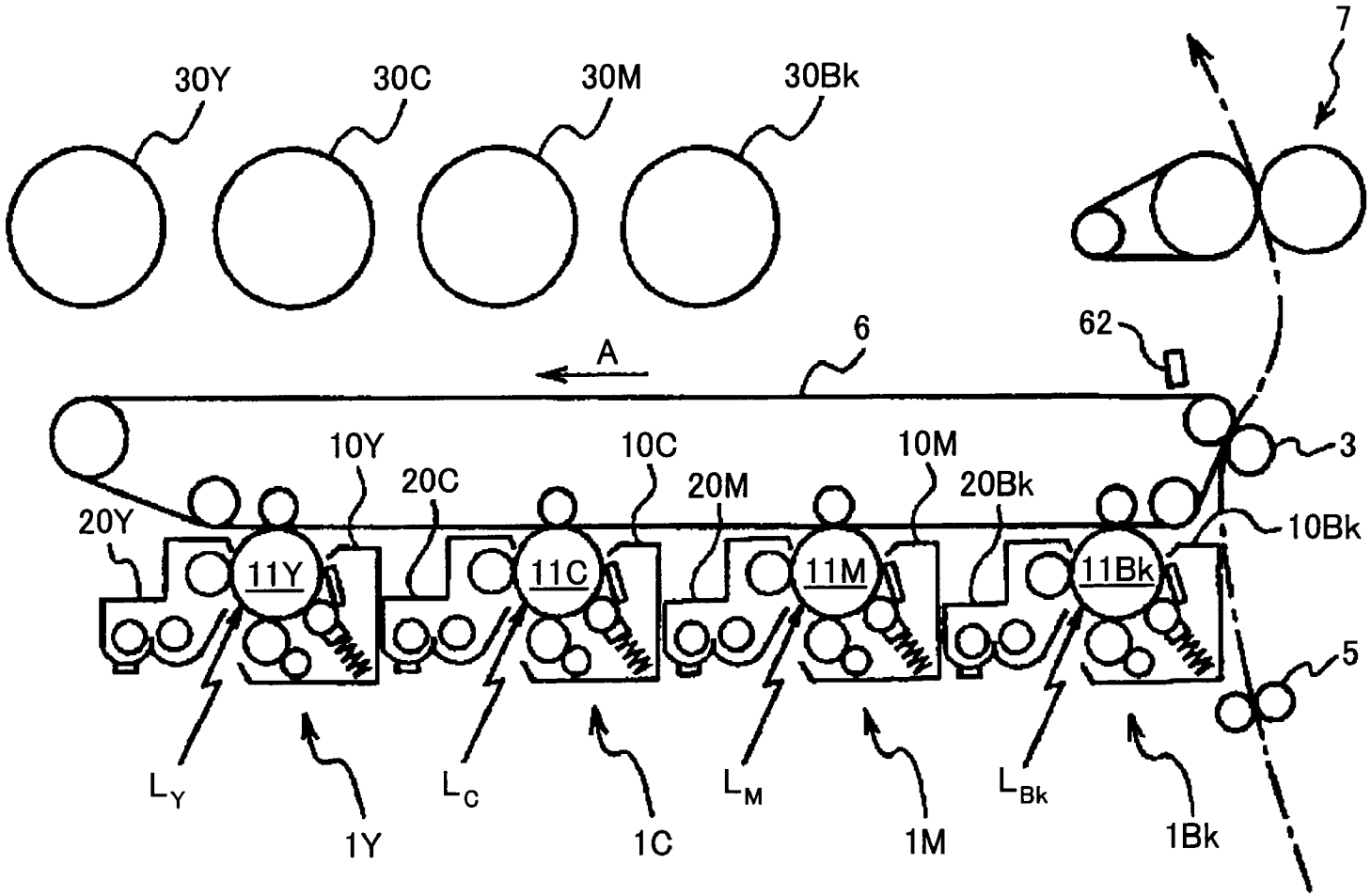
FIG. 2 is a diagram showing relevant components of a laser printer.

FIG. 2 is a diagram showing main components of the laser printer according to the present embodiment.

The illustrated laser printer includes four image creating parts 1Y, 1C, 1M, and 1B*k* for creating color images in magenta (M), cyan (C), yellow (Y), and black (Bk), respectively. Specifically, the image creating parts 1Y, 1C, 1M, and 1B*k* are arranged in this order from the upstream side along the surface moving direction (direction of arrow A in FIG. 2) of an intermediate transfer belt 6 corresponding to an intermediate transfer medium. It is noted that the subscripts Y, C, M, and Bk attached to numerical references representing various components described hereinafter indicate the association of the components with the colors yellow, cyan, magenta, and black, respectively. The image creating parts 1Y, 1C, 1M, and 1B*k* each include a photoconductor unit 10Y, 10C, 10M, and 10B*k* having a drum-shaped photoconductor 11Y, 11C, 11M, 11*k* as a latent image carrier and a developing apparatus 20Y, 20C, 20M, and 20B*k*. The image creating parts 1Y, 1C, 1M, and 1B*k* are aligned along the surface moving direction of the intermediate transfer belt 6 at a predetermined pitch and arranged such that the rotational axes of the photoconductors 11Y, 11C, 11M, and 11B*k* of the photoconductor units 10Y, 10C, 10M, and 10B*k* may be parallel.

A first image transfer process is performed by successively overlaying toner images formed on the photoconductors 11Y, 11C, 11M, and 11B*k* by the image creating parts 1Y, 1C, 1M, and 1B*k*. The color image obtained by overlaying the toner images is conveyed to a second transfer part between second transfer rollers 3 through surface movement of the intermediate transfer belt 6. It is noted that the present laser printer also has an optical write unit (not shown) as latent image forming means arranged below the image creating parts 1Y, 1C, 1M, and 1B*k* and a paper feed cassette (not shown) arranged below the optical write unit. The one dotted line in FIG. 2 represents the conveying path of transfer paper. Transfer paper that is fed from the paper feed cassette is guided by a conveying guide (not shown) and conveyed by a conveying roller (not shown) to a temporary halt position between resist rollers 5. The transfer paper is fed to the second transfer part at a predetermined timing by the resist rollers 5. In turn, a second transfer process is performed by transferring the color image formed on the intermediate transfer belt 6 onto the transfer paper so that a color image may be formed on the transfer paper. The transfer paper having the color image formed thereon is conveyed to a fixing unit 7 to have its toner image fixed and is then delivered onto a paper delivery tray 8.

Figure 3:
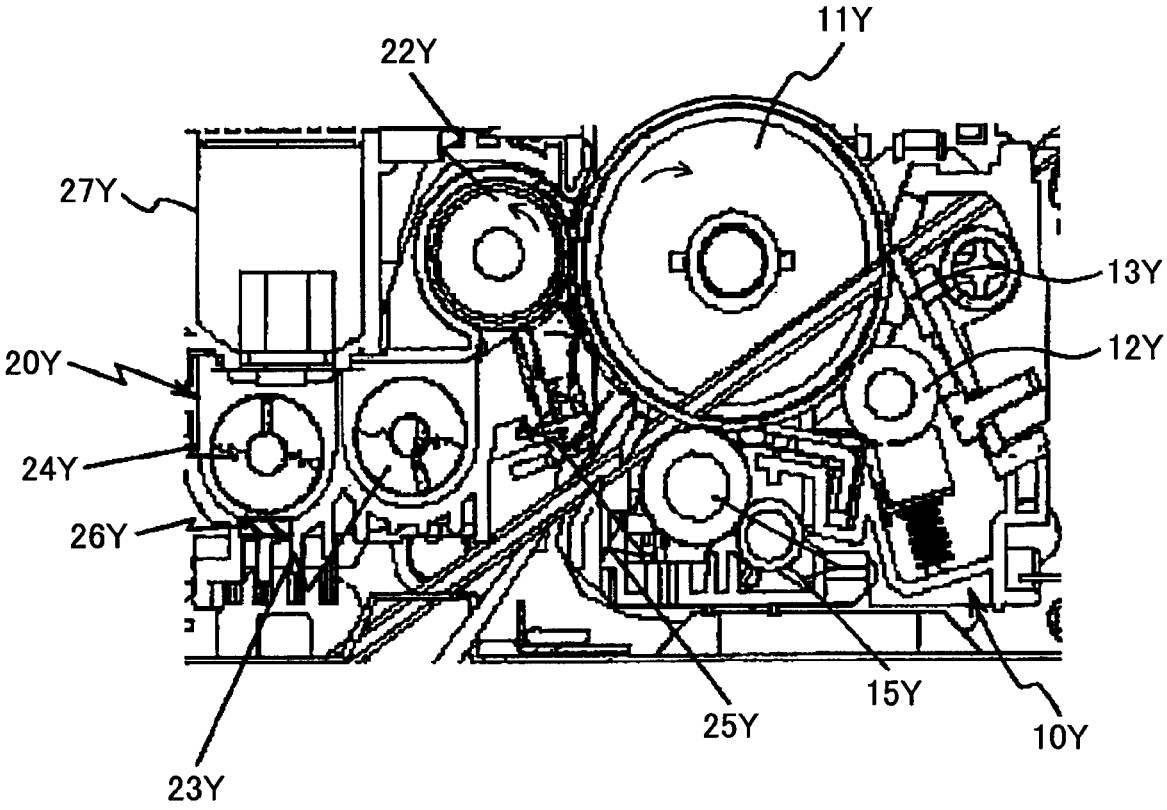
FIG. 3 is a diagram showing a configuration of a yellow image creating unit of the laser printer of FIG. 2.

FIG. 3 is an enlarged view of the yellow image creating part 1Y of the above-described image creating parts 1Y, 1C, 1M, and 1B*k*. It is noted that the other image creating parts 1C, 1M, and 1B*k* may have similar configurations to that of the yellow image creating part 1Y as is described below.

As is described above, the image creating part 1Y includes the photoconductor unit 10Y and the developing apparatus 20Y. The photoconductor unit 10Y includes the photoconductor 11Y as well as a cleaning blade 13Y for cleaning the photoconductor surface, a charge roller 15Y for evenly charging the photoconductor surface, and a lubricant applying/static eliminating brush roller 12Y for applying a lubricant to the photoconductor surface and removing electrostatic charge from the photoconductor surface. The lubricant applying/static eliminating brush roller 12Y has a brush part that is made of conductive fiber and a core metal part including a static eliminating power source (not shown) for applying a static eliminating bias.

In the photoconductor unit 10Y having the above-described configuration, the surface of the photoconductor 11Y is evenly charged by the charge roller 15Y, which has a voltage applied thereto. When a laser beam $L_Y$ that is modulated and deflected by the write unit (not shown) is scanned and irradiated on the surface of the photoconductor 11Y, an electrostatic latent image is formed on the surface of the photoconductor 11Y. The electrostatic latent image formed on the surface of the photoconductor 11Y is then developed into a yellow toner image by the developing apparatus 20Y. At the first transfer part corresponding to the point at which the photoconductor 11Y faces the intermediate transfer belt 6, the toner image formed on the photoconductor 11Y is transferred onto the intermediate transfer belt 6. After the toner image is transferred on to the intermediate transfer belt 6, the surface of the photoconductor 11Y is cleaned by the cleaning blade 13. Then, a predetermined amount of lubricant is applied on the surface of the photoconductor 11Y and static is removed therefrom by the lubricant applying/static eliminating brush roller 12Y so that the photoconductor 11Y may be prepared for a next latent image formation process.

In the present embodiment, the developing apparatus 20Y uses a two component developer including a magnetic carrier and a negative charge toner (simply referred to as 'developer' hereinafter) for developing the electrostatic latent image. The developing apparatus 20Y includes a developing sleeve 22Y as a developer carrier made of nonmagnetic material that is partially exposed from a photoconductor side opening of a developer case, a magnet roller (not shown) as magnetic field generating means stationed within the developing sleeve 22Y, first and second stirring/conveying screws 23Y and 24Y as stirring/conveying members for stirring the developer, a developing doctor 25Y, a magnetic permeability sensor 26Y as toner density detection means, and a power pump 27Y as toner supply means, for example. A developing bias source (not shown) as developing electric field generating means applies a developing bias voltage to the developing sleeve 22Y which developing bias voltage is generated by superposing an alternating current voltage AC (alternating current component) onto a negative direct current voltage DC (direct current component). Alternatively, the developing bias voltage applied to the developing sleeve 22Y may merely include the negative direct current voltage DC (direct current component).

In the illustrated embodiment of FIG. 3, the developer accommodated within the developer case is stirred and conveyed by the first and second stirring/conveying screws 23Y and 24Y so that the toner may be electrically charged through friction. The surface of the developing sleeve 22Y is arranged to hold a portion of the developer within a first stirring/conveying path at which the first stirring/conveying screw 23Y is arranged, and the thickness of the developer layer on the developing sleeve 22Y is regulated by the developing doctor 25Y. Then, the developer layer is conveyed to a developing region opposite the photoconductor 11Y. At the developing region, the toner contained in the developer layer on the developing sleeve 22Y is attracted to the electrostatic latent image formed on the photoconductor 11Y by the developing electric field so that the electrostatic latent image is developed into a toner image. Then, the developer having passed the developing region is separated from the surface of the developing sleeve 22Y at a developer separating pole position on the developing sleeve 22Y to be sent back to the first stirring/conveying path. The developer that is conveyed to the downstream end of the first stirring/conveying path is transferred to the upstream end of a second stirring/conveying path at which the second stirring/conveying screw 24Y is arranged. It is noted that toner is supplied within the second stirring/conveying path. Then, the developer is conveyed to the downstream end of the second stirring/conveying path to be transferred to the upstream end of the first stirring/conveying path. The magnetic permeability sensor 26Y is arranged at a developer case portion making up the bottom portion of the second stirring/conveying path.

Since the toner density of the developer accommodated within the developer case decreases in response to toner consumption during image formation, the toner density is controlled to be within a desirable density range by supplying toner from a toner cartridge 30Y (see FIG. 2) via the power pump 27Y as is necessary or desired according to the output value Vt of the magnetic permeability sensor 26Y. Specifically, the toner supply control operations may be performed based on a difference value Tn between the output value Vt and a target output value $Vt_{ref}$ corresponding to a toner density control reference value ($Tn=Vt_{ref}-Vt$). That is, when the difference value Tn is a positive value, it may be determined that the toner density is adequately high so that toner supply operations is not be necessary. On the other hand, when the difference value Tn is a negative value, toner supply operations are controlled so that the amount of toner supplied may be in proportion to the absolute value of the difference value Tn; namely, the greater the absolute value of the difference value Tn, the greater the toner supply amount. In this way the output value Vt is controlled to be closer to the target output value $Vt_{ref}$.

Also, control conditions such as the target output value $Vt_{ref}$, the charge potential, and the light intensity may be periodically adjusted through process control each time image formation is performed on a given number of pages such as 10-50 pages (the number of pages may be within a range of approximately 5-200 pages depending on factors such as the copying speed). In one specific example, plural halftone and solid patterns formed on the photoconductor 11Y may be transferred onto the intermediate transfer belt 6, the densities of the patterns may be detected by a reflection density sensor 62 shown in FIG. 2, the amount of toner adhered to the intermediate transfer belt 6 may be determined based on the detection values, and conditions such as the target output value $Vt_{ref}$, the charge potential, and the light intensity may be adjusted so that the toner adhering amount may be controlled to a desired amount.

According to the present embodiment, in addition to performing process control after every predetermined number of image forming jobs, a process of correcting the target output value $Vt_{ref}$ is performed for every image forming job, the details of which are described below in relation to toner density control operations.

Also, in the illustrated embodiment, the photoconductor 11B*k* for forming a black image that is located at the downstream end of the alignment of the photoconductors 11Y, 11C, 11M, and 11B*k* has a transfer nip that is always held in contact with the intermediate transfer belt 6. The other photoconductors 11Y, 11C, and 11M can be adjusted to be in contact with or held apart from the intermediate transfer belt 6. Specifically, in the case of forming a color image, the four photoconductors 11Y, 11C, 11M, and 11B*k* are each held in contact with the intermediate transfer belt 6. On the other hand, in the case of forming a black and white image on transfer paper, the color photoconductors 11Y, 11C, and 11M are held apart from the intermediate transfer belt 6 and only the photoconductor 11B*k* for forming an image with black toner may be held in contact with the intermediate transfer belt 6.

In the following, a control unit for enabling image density control operations is described.

Figure 4:
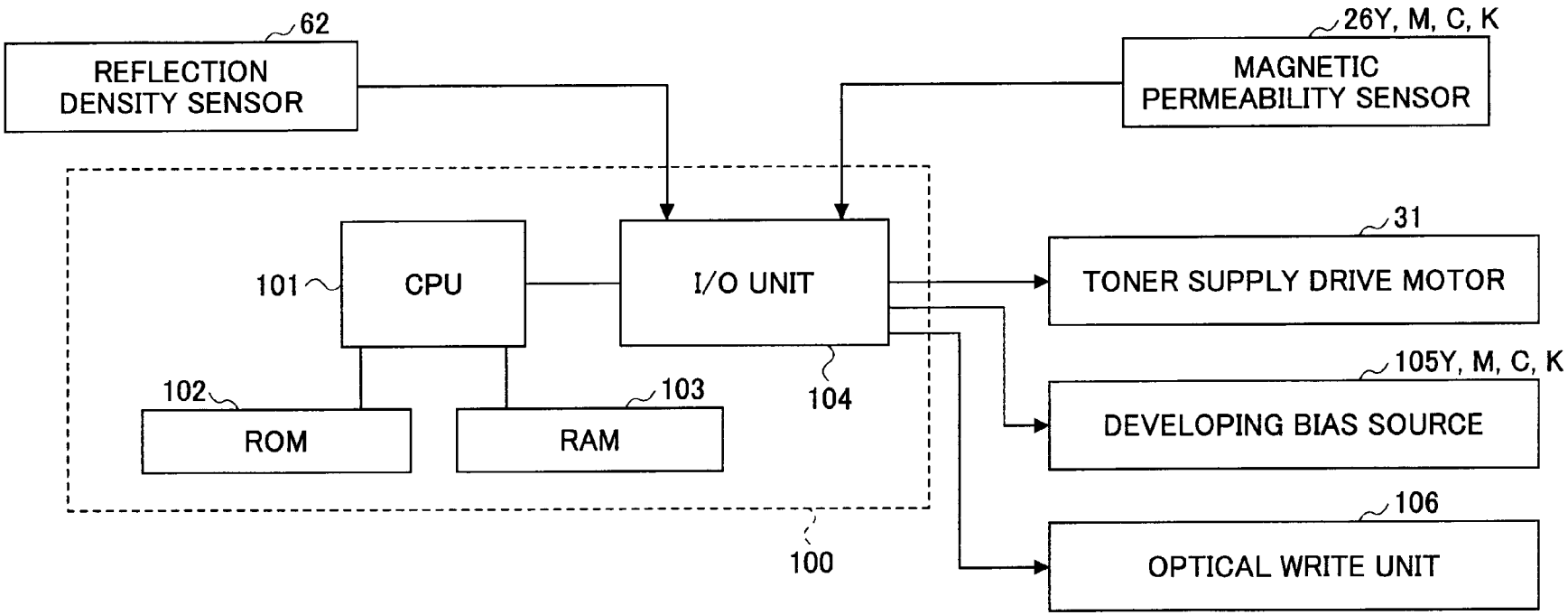
FIG. 4 is a block diagram showing a configuration of a control unit of the laser printer shown in FIG. 2 for performing toner density control operations.

FIG. 4 is a diagram showing a configuration of a control unit 100 according to an embodiment of the present invention.

The illustrated control unit 100 includes a CPU 101, a ROM 102, a RAM 103, and an I/O unit 104. The I/O unit 104 is connected to the magnetic permeability sensors 26Y, 26C, 26M, 26B*k* (simply referred to as 'magnetic permeability sensor 26' hereinafter), and the reflection density sensor 62 via corresponding A/D converters (not shown). The control unit 100 may control toner supply operations by having the CPU 101 execute a predetermined toner density control program to transmit a control signal via the I/O unit 104 to a toner supply drive motor 31 that drives the particle pumps 27Y, 27C, 27M, and 27B*k* (simply referred to as 'particle pump 27' hereinafter). In other words, the control unit 100 may function as a toner density control unit for controlling the toner densities of the developers accommodated within the developing apparatuses 20Y, 20C, 20M, and 20B*k* (simply referred to as 'developing apparatus 20' hereinafter) corresponding to image density control conditions. Also, the control unit 100 may have the CPU 101 execute a predetermined potential control program to transmit control signals to developing bias sources 105Y, 105C, 105M, and 105B*k*, or an optical write unit 106 via the I/O unit 104 and control the developing bias voltages applied to the developing sleeves 22Y, 22C, 22M, and 22B*k* of the developing apparatuses 20 or the outputs of laser beams irradiated on the photoconductors 11Y, 11C, 11M, and 11B*k* (simply referred to as 'photoconductor drum 11' hereinafter) corresponding to image density control conditions. In other words, the control unit 100 may function as a potential control unit for controlling the developing potential by adjusting the photoconductor surface potential and the developing sleeve surface potential.

Also, the control unit 100 may have the CPU 101 execute a predetermined target output value correction program to correct the target output value $Vt_{ref}$ with respect to each image forming job so that the image density may be maintained at a fixed level. The ROM 102 stores programs such as the toner density control program and the target output value correction program that are to be executed by the CPU 101, for example. The RAM 103 may include a Vt register for temporarily storing the output value Vt of the magnetic permeability sensor 26 acquired via the I/O unit 104, a $Vt_{ref}$ register storing the target output value $Vt_{ref}$ that is to be output by the magnetic permeability sensor 26 when the toner density of the developer within a developing apparatus 20 corresponds to the target toner density, and a Vs register that stores the output value Vs from the reflection density sensor 62, for example.

According to one embodiment, the control unit 100 may also function as an image density control condition modifying unit and a toner pattern detection unit. In one specific example, a first target output value correction unit may be used as an exemplary image density control condition modifying unit and a second target output value correction unit may be used as an exemplary toner pattern detection unit as is described in detail below. Also, the control unit 100 may function as a parameter modifying unit. It is noted that in the following descriptions, control elements of the control unit 100 may be referred to as 'potential control unit', 'first target output value correction unit', 'second target output value correction unit', and 'parameter modifying unit' according to their functions.

An example is described below in which the first target output value correction unit as an exemplary image density control condition modifying unit is configured to correct the target toner density of the developer contained in a developing apparatus as an image density control condition.

Figure 5:
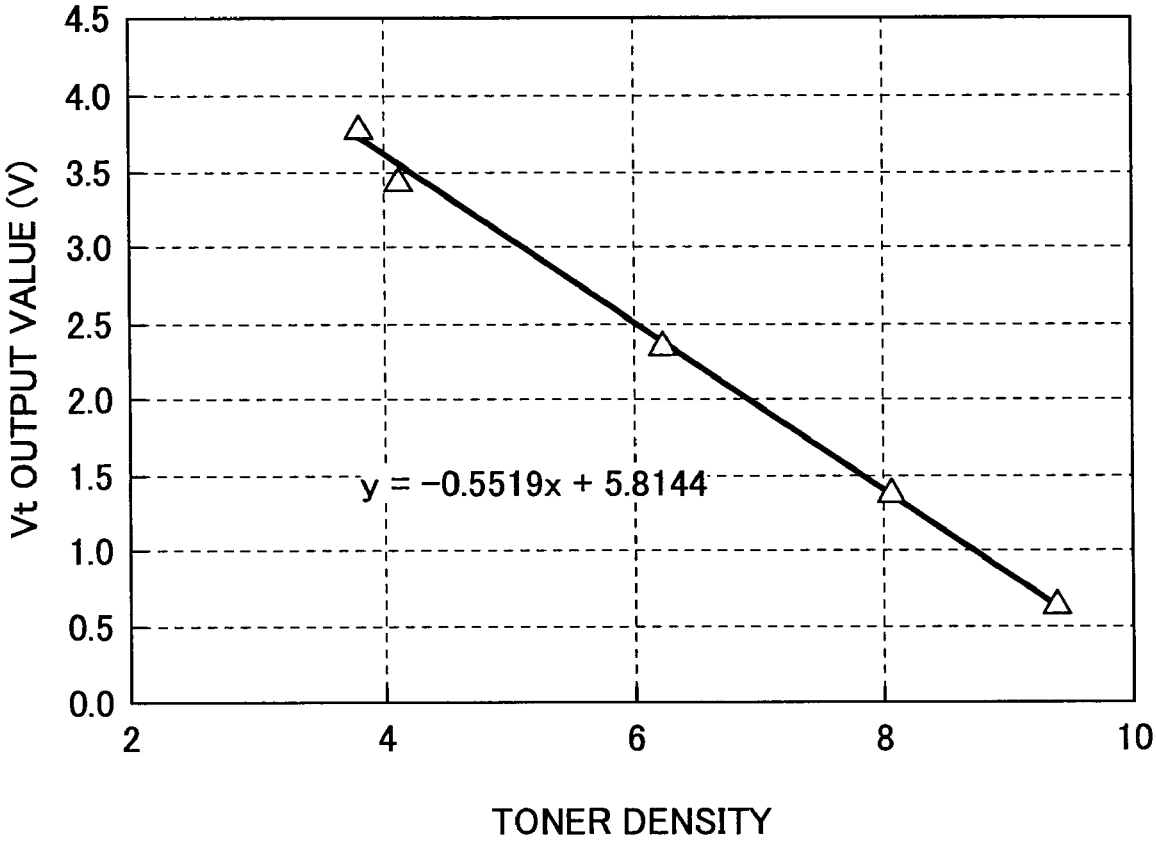
FIG. 5 is a graph having a vertical axis representing the output value of a magnetic permeability sensor and a horizontal axis representing the toner density of a developer subject to detection.

FIG. 5 is a graph representing the output value of the magnetic permeability sensor 26 on the vertical axis and the toner density of the developer subject to detection on the horizontal axis.

As can be appreciated from this graph, the output value of the magnetic permeability sensor 26 and the toner density of the developer may have a substantially linear relationship within a practical toner density range. Specifically, the output value of the magnetic permeability sensor 26 becomes smaller as the toner density of the developer increases. Based on such a characteristic relationship, the particle pump 27 is driven to perform toner supply operations when the output value Vt of the magnetic permeability sensor 26 is greater than the target output value $Vt_{ref}$. On the other hand, when the output value Vt of the magnetic permeability sensor 26 is less than the target output value $Vt_{ref}$, drive operations of the particle pump 27 are stopped so that toner supply operations are not performed. In the present example, toner supply control operations are performed based on the output value Vt of the magnetic permeability sensor 26 with respect to each image forming job.

In the following, control operations for a target output value correction process according to an embodiment of the present invention are described with reference to FIG. 1. In the illustrated embodiment of FIG. 1, control elements for performing the control operations for the output value correction process include the potential control unit, the first target output value correction unit, and the second output value correction control unit. The potential control unit is configured to detect development γ characteristics (developing capacity) of the developing apparatus 20 to determine the developing bias and a laser beam output parameter for the optical write apparatus and change the target output value $Vt_{ref}$. Such control operations by the potential control means may be periodically performed each time 200 pages of color images are output, for example.

The first target output value correction unit is configured to calculate the target output value $Vt_{ref}$ based on the amount of toner exchanged at the developing apparatus and a parameter (a), and modify the target output value $Vt_{ref}$ as is described in detail below. The control operations by the first target output value correction unit may be performed with respect to each image forming job.

The second target output value correction unit is configured to form a toner pattern on the intermediate transfer belt 6 located between two transfer images that are to be successively transferred onto two sheets of transfer paper. Specifically, the toner pattern is formed on a section of the intermediate transfer belt 6 between the rear edge of the transfer image to be transferred onto the first sheet and the front edge of the transfer image to be transferred onto the second sheet following the first sheet. The second target output value correction unit is configured to detect the toner pattern with the reflection density sensor 62 to change the target output value $Vt_{ref}$. The control operations by the second target output value correction unit may be periodically performed each time image forming operations are performed on 10-50 pages of transfer paper, for example. It is noted that in the case of forming a toner pattern on the intermediate transfer belt 6 during successive printing of plural transfer sheets, the toner pattern is formed between the transfer images for a first transfer sheet and the transfer image for a second sheet following the first transfer sheet. In other words, the toner pattern is formed on a section of the intermediate transfer belt 6 between the rear edge of an image region for the first sheet and the front edge of an image region for the second sheet.

It is noted that parameter modification is performed when the second target output value correction process is performed. That is, the parameter modifying unit modifies the parameter (a) based on the image density of the toner pattern formed during the second target output value correction process.

As can be appreciated from the above descriptions, the potential control unit, the first target output value correction unit, and the second target output value correction unit each perform control operations at different intervals to control the toner density to a desired density. It is noted that the interval between corrections performed on the target output value $Vt_{ref}$ by the potential control unit may be the longest, and the interval between corrections performed on the target output value $Vt_{ref}$ by the first target output value correction unit may be the shortest.

In the following, the target output value correction process by the potential control unit is described in detail. First, in order to detect the development γ characteristics (developing capacity) of a corresponding developing apparatus 20, the developing potential is changed to form toner patterns in 10 different gray levels on the photoconductor 11 for density detection. The toner patterns are formed by fixing the potential of the laser beam being irradiated from the optical write unit and changing the developing bias and the charge bias. It is noted that the background potential corresponding to the difference between the charge bias and the developing bias is fixed to 100 V upon forming the toner pattern. Also, it is noted that the toner patterns are successively formed starting with the lower developing potential.

Next, the toner patterns developed on each photoconductor 11 by its corresponding developing apparatus 20 are transferred on the intermediate transfer belt 6. It is noted that in the present example, ten toner patterns for density detection are formed at each of the image creating units 1Y, 1C, 1M, and 1B*k*. However, detection of the development γ characteristics may be possible using a fewer number of different toner patterns than the present example. In a preferred embodiment, at least three toner patterns having different densities are formed for detecting the development γ characteristics. The toner densities of the toner patterns for density detection corresponding to the four different colors that are transferred on the intermediate transfer belt 6 are simultaneously detected by four reflection density sensors 62 that are aligned parallel at the downstream side of the rotation direction of the intermediate transfer belt 6. Then, each detected toner density is converted into a toner adhesion amount ($mg/cm^2$) to obtain a relational expression representing the toner adhesion amount in relation to the developing potential (−kV). It is noted that the slope of the relational expression represents the development γ characteristics corresponding to the developing capacity. Also, a developing bias value for acquiring a target toner adhesion amount can be calculated from the above relational expression. It is noted that different values may be set as the development γ target value $Vt_{ref}$ for the control operations by the potential control unit depending on various factors such as the environment, the rotation distance of the developing sleeve 22 (m), and/or the photoconductor rotation time (sec). The development γ target value $Vt_{ref}$ that is currently set for the potential control operations is compared with the current development γ value calculated from the above relational expression. If the current development γ value is greater than the target value $Vt_{ref}$, the target value $Vt_{ref}$ is increased in order to obtain a lower toner density. On the other hand, if the current development γ value is less than the target value $Vt_{ref}$, the target value $Vt_{ref}$ is decreased in order to obtain a higher toner density. It is noted that in the present example, the developing bias value is calculated from the relational expression representing the toner adhesion amount ($mg/cm^2$) in relation to the developing potential (−kV); however, the present invention is not limited to such an example, and the laser beam output parameter may be calculated in another example.

Figure 6:
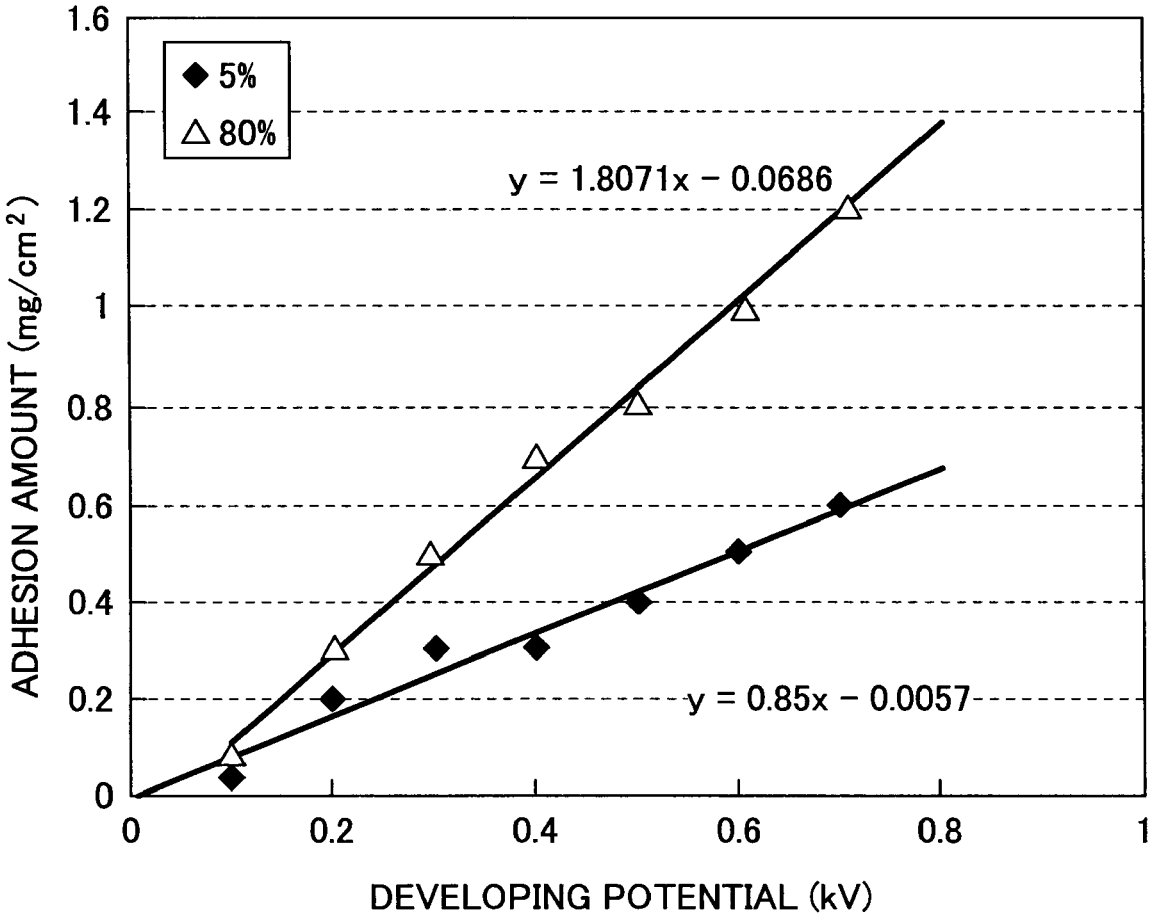
FIG. 6 is a graph showing differences in the development $\gamma$ depending on the output image area ratio.

In the following, a target output correction process performed by the first target output value correction unit is described. FIG. 6 is a graph showing differences in development γ characteristics (i.e., slope of the relational expression of the toner adhesion amount in relation to the developing potential) depending on the output image area ratio. Specifically, the graph of FIG. 6 represents development γ characteristics obtained from two exemplary cases in each of which 100 pages of images with identical image area ratios are successively output in standard line speed mode (138 mm/sec). As can be appreciated from this graph, a higher development γ value is obtained when images with a higher image area ratio are output. Such an effect may possibly be explained by the fact that when images with a relatively high image area ratio are output, the amount of toner exchanged at the developing apparatus 20 within a predetermined period of time may be greater than the case in which images with a relatively low image area ratio are output so that the amount of toner residing within the developing apparatus 20 for a relatively long period of time may be relatively small. Thus, in this case, the amount of toner in the developing apparatus 20 that is overcharged as a result of residing within the developing apparatus 20 for a long period of time may be less than the case in which images with a relatively low image area ratio are output so that a higher developing capacity may be achieved.

As is described above, differences in the amount of toner exchanged at the developing apparatus 20 within a predetermined period of time may create differences in the developing capacity of subsequent image forming operations. In turn, such differences in the developing capacity may create differences in the image density of images formed by the image forming operations so that image may not be formed at a fixed image density. Accordingly, measures are taken to correct the target output value $Vt_{ref}$ in order to maintain a fixed development γ value in principle so that the developing capacity may be maintained at a fixed level even when the amount of toner exchanged at the developing apparatus 20 within a predetermined period of time may vary. By correcting the target output value $Vt_{ref}$, the toner density may be adjusted so that the output value Vt of the magnetic permeability sensor 26 may approximate the corrected target output value $Vt_{ref}$. Thus, the developing capacity may be maintained at a fixed level by adjusting the toner density to be lower when a relatively large amount of toner is exchanged at the developing apparatus 20 (e.g., when one or more images with a high image area ratio are output) so that the developing capacity may be decreased; and adjusting the toner density to be higher when a relatively small amount of toner is exchanged at the developing apparatus 20 (e.g., when one or more images with a low image area ratio are output) so that the developing capacity may be increased.

It is noted that the amount of toner exchanged at the developing apparatus 20 over a predetermined time period may be determined based on various information such as the output image area ($cm^2$) or the image area ratio (%). In the following, an example is described in which the amount of exchanged toner is determined based on the image area ratio (%). In the present example, the image area ratio (%) is converted into a value representing the amount of exchanged toner (mg/page). It is assumed in the present example that when image forming operations are performed at an appropriate developing capacity, 300 (mg) of toner is consumed upon outputting a 100% solid image on a sheet of A4 size transfer paper and 300 (mg) of toner is supplied to the developing apparatus 20 accordingly. In this case, the toner exchange amount may be 300 (mg/page). In the case of converting an image area ratio into a toner exchange amount, if A4 long edge feed transfer paper is set as the reference transfer sheet, for example, each transfer sheet to be output has to be converted into the reference transfer sheet and the corresponding image area ratio has to be converted accordingly. It is assumed that the developing capacity of the developing apparatus 20 is 240 (g) in the present example. It is noted that calculations for converting an image area ratio into a corresponding toner exchange amount may be performed by the control unit 100, for example. In this case, the control unit 100 may function as an information detection unit for detecting information for determining the toner exchange amount.

Figure 7:
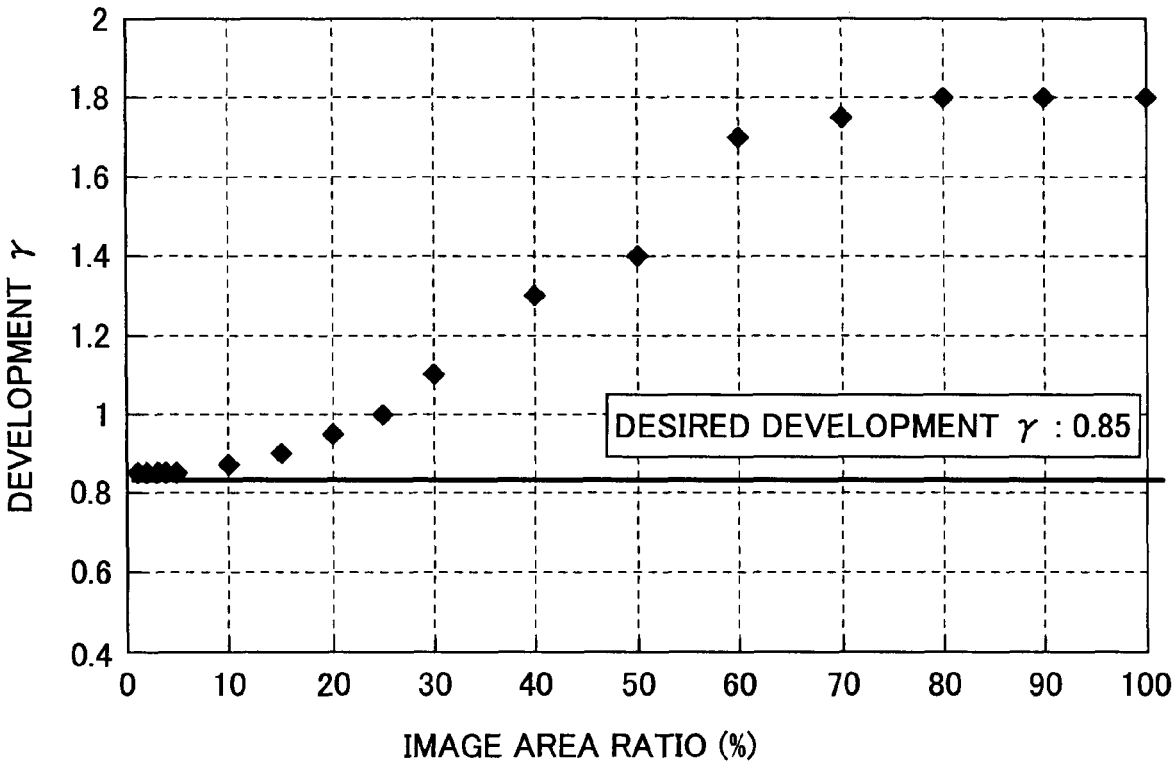
FIG. 7 is a graph having a horizontal axis representing the image area ratio and a vertical axis representing the development $\gamma$.

FIG. 7 is a graph representing the image area ratio (%) on the horizontal axis and the development γ ($mg/cm^2/kV$) on the vertical axis.

It is noted that the graph of FIG. 7 represents the development γ for each image area ratio in a case where 100 pages of images are successively output in standard line speed mode while maintaining the toner density at a fixed level as in the case of FIG. 6. As can be appreciated from this graph, the development γ starts to rise after the image area ratio exceeds a reference value of 5(%). Accordingly, in the present example, when the image area ratio is greater than 5(%), the target output value $Vt_{ref}$ is increased so that the toner density to decreased, and the development γ is decreased so that the image density may be maintained at a fixed level. On the other hand, after the target output value $Vt_{ref}$ is increased, when one or more images with an image area ratio of 5(%) or lower is output, the target output value $Vt_{ref}$ is decreased so that the toner density may be increased.

Figure 8:
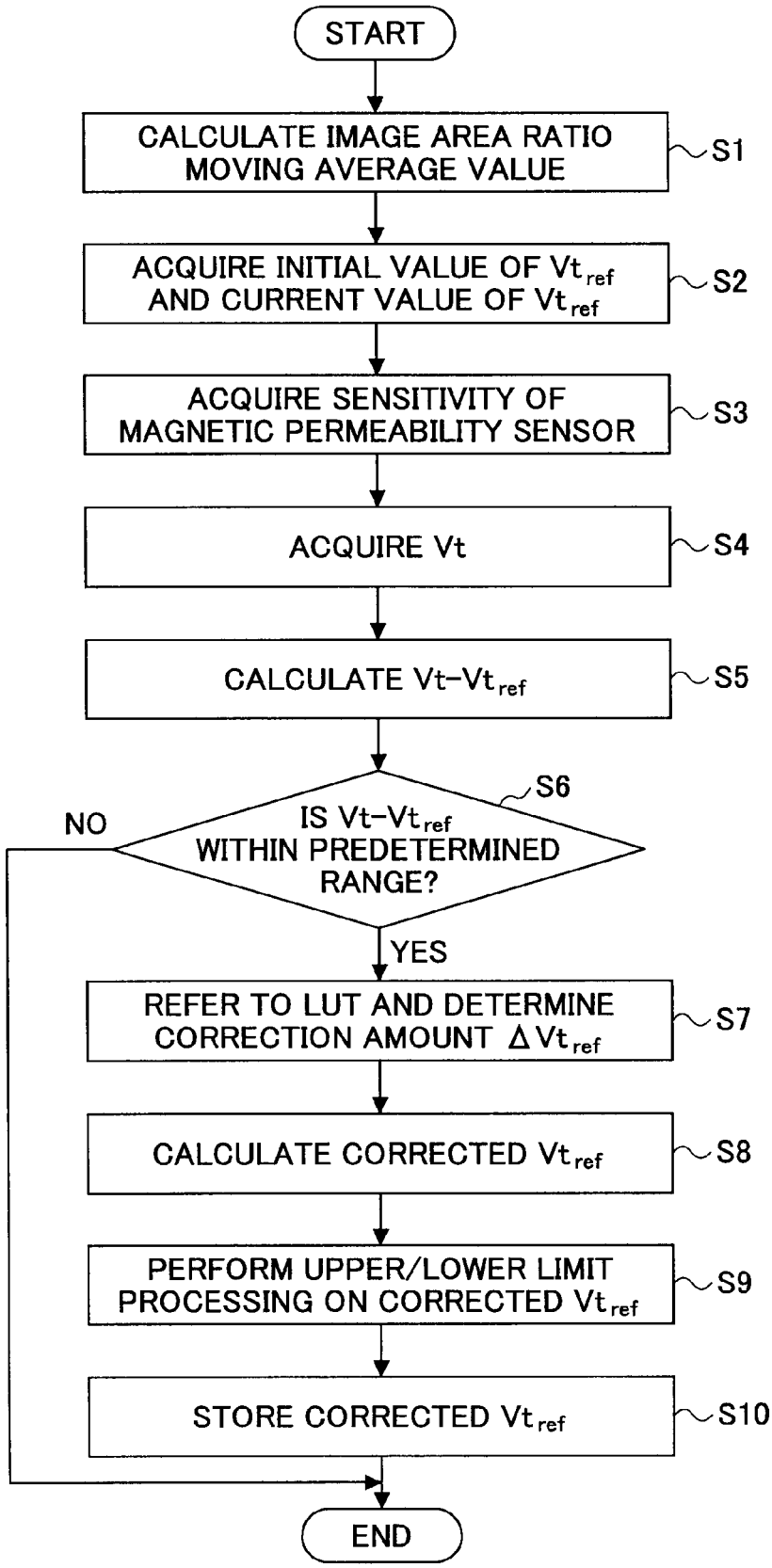
FIG. 8 is a flowchart showing process steps of a target output value correction process performed by a first target output value correction process.

FIG. 8 is a flowchart illustrating process steps of a target output value correction process performed by the first target output value correction unit.

It is noted that the illustrated target output value correction process is performed after the completion of each printing job. Specifically, after a given printing job is completed, the control unit 100 calculates the moving average value of the image area ratios (%) of images output within a predetermined time period, namely, the moving average value of the image area ratios of several to several dozen pages of previously printed images (step S1). It is noted that the calculation does not necessarily have to be for obtaining the moving average value of the image area ratios (%) and may alternatively be for obtaining a simple average of the image area ratios of the previously printed images, for example. However, by obtaining the moving average value, past toner exchange amounts for several to several dozen pages of previously printed images may be known to better determine the current toner characteristics at the present moment. Therefore, in the example described below, the moving average value of the image ratios of previously printed images is used. Specifically, in the present example, the moving average value is obtained by calculating the following formula (1):

$$M(i)=(1/N)\{M(i-1)\times(N-1)+X(i)\} \quad (1)$$

In the above formula (1), 'N' denotes the sampling number of image area ratios (number of pages), 'M(i−1)' denotes a previously calculated moving average value calculated before the present calculation, and 'X(i)' denotes the image area ratio of the image that has just been subject to detection (most recent detection result). It is noted that in the present example, M(i) and X(i) for each color are individually calculated.

By using the moving average value obtained in a previous calculation to calculate the present moving average value, data on the image area ratios of several to several dozen pages of previously printed images do not have to be stored in the RAM 103 so that the storage area used for storing information pertaining to the image area ratio may be substantially reduced. Also, the number of pages N may be changed as is desired to change the control response. For example, the number of pages N may be changed in accordance with environmental change or time lapse to realize effective control.

After calculating the moving average value in the manner described above, the control unit 100 acquires the current value of the target output value $Vt_{ref}$ and the initial value of the target output value $Vt_{ref}$ (step S2). It is noted that in the present example, the initial value and the current value of the target output value $Vt_{ref}$ are defined by the following formula (2):

$$(\text{Current Value of } Vt_{ref}) = (\text{Initial Value of } Vt_{ref}) + \Delta Vt_{ref} \quad (2)$$

The control unit 100 also acquires sensitivity information of the magnetic permeability sensor 26 (step S3). The sensitivity of the magnetic permeability sensor 26 is a value unique to each magnetic permeability sensor that is represented by 'V/wt %' (i.e., the absolute value of the slope of the line plotted in the graph of FIG. 5 corresponds to the sensitivity of the magnetic permeability sensor 26 in the present example). Then, the control unit 100 acquires the output value of the permeability magnetic sensor 26 that has just been output (step S4), and uses the current value of the target output value $Vt_{ref}$ to calculate the value of $Vt-Vt_{ref}$ (step S5). Then, the control unit 100 determines whether to correct the target output value $Vt_{ref}$. For example, the determination may be made based on whether previous process control has been successful or whether the difference value $Vt-Vt_{ref}$ calculated in step S5 is within a predetermined range as the determination criteria. In the present example, a determination is made as to whether the difference value $Vt-Vt_{ref}$ is within a predetermined range (step S6).

In the case where the calculated difference value $Vt-Vt_{ref}$ is within a predetermined range, the control unit 100 refers to a LUT (lookup table) to determine the correction amount $\Delta Vt_{ref}$ corresponding to the amount of change to be made to the target output value $Vt_{ref}$ (step S7). Specifically, first, the control unit 100 refers to the LUT to determine the toner density correction amount ΔTC (i.e., the degree of change to be made to the toner density) corresponding to the moving average value calculated in step S1. After determining the toner density correction amount ΔTC, the control unit 100 uses the sensitivity of the magnetic permeability sensor 26 acquired in step S3 and the parameter (a) to calculate the correction amount $\Delta Vt_{ref}$ for the target output value $\Delta Vt_{ref}$ from the following formula (3):

$$\Delta Vt_{ref} = (-1) \times \Delta TC \times a \times (\text{Sensitivity of Magnetic Permeability Sensor 26}) \quad (3)$$

In the above formula (3), 'a' denotes a one-degree-of-freedom parameter, which may be modified by a parameter modifying unit as is described in detail below. The following table 1 illustrates an exemplary LUT in the case where the sensitivity of the magnetic permeability sensor 26 is 0.3.

TABLE 1

LUT (Sensor Sensitivity: 0.3)

| Image Area Progressive Average (%) | Δ TC (wt %) | $\Delta Vt_{ref}$ = (−1) × Δ TC × a × (Sensor Sensitivity) (V/wt %) |
|---|---|---|
| Mi < 1 | 0.5 | −0.15 × a |
| 1 ≦ Mi < 2 | 0.4 | −0.12 × a |
| 2 ≦ Mi < 3 | 0.3 | −0.09 × a |
| 3 ≦ Mi < 4 | 0.2 | −0.06 × a |
| 4 ≦ Mi < 5 | 0.0 | 0.00 |
| 5 ≦ Mi < 6 | 0.0 | 0.00 |
| 6 ≦ Mi < 7 | −0.1 | 0.03 × a |
| 7 ≦ Mi < 8 | −0.2 | 0.06 × a |
| 8 ≦ Mi < 9 | −0.3 | 0.09 × a |
| 9 ≦ Mi < 10 | −0.4 | 0.12 × a |
| 10 ≦ Mi < 20 | −0.5 | 0.15 × a |
| 20 ≦ Mi < 30 | −0.6 | 0.18 × a |
| 30 ≦ Mi < 40 | −0.7 | 0.21 × a |
| 40 ≦ Mi < 50 | −0.8 | 0.24 × a |
| 50 ≦ Mi < 60 | −0.9 | 0.27 × a |
| 60 ≦ Mi < 70 | −1.0 | 0.30 × a |
| 70 ≦ Mi < 80 | −1.0 | 0.30 × a |
| 80 ≦ Mi | −1.0 | 0.30 × a |

In the following, the manner in which the above LUT is created is described.

Figure 9:
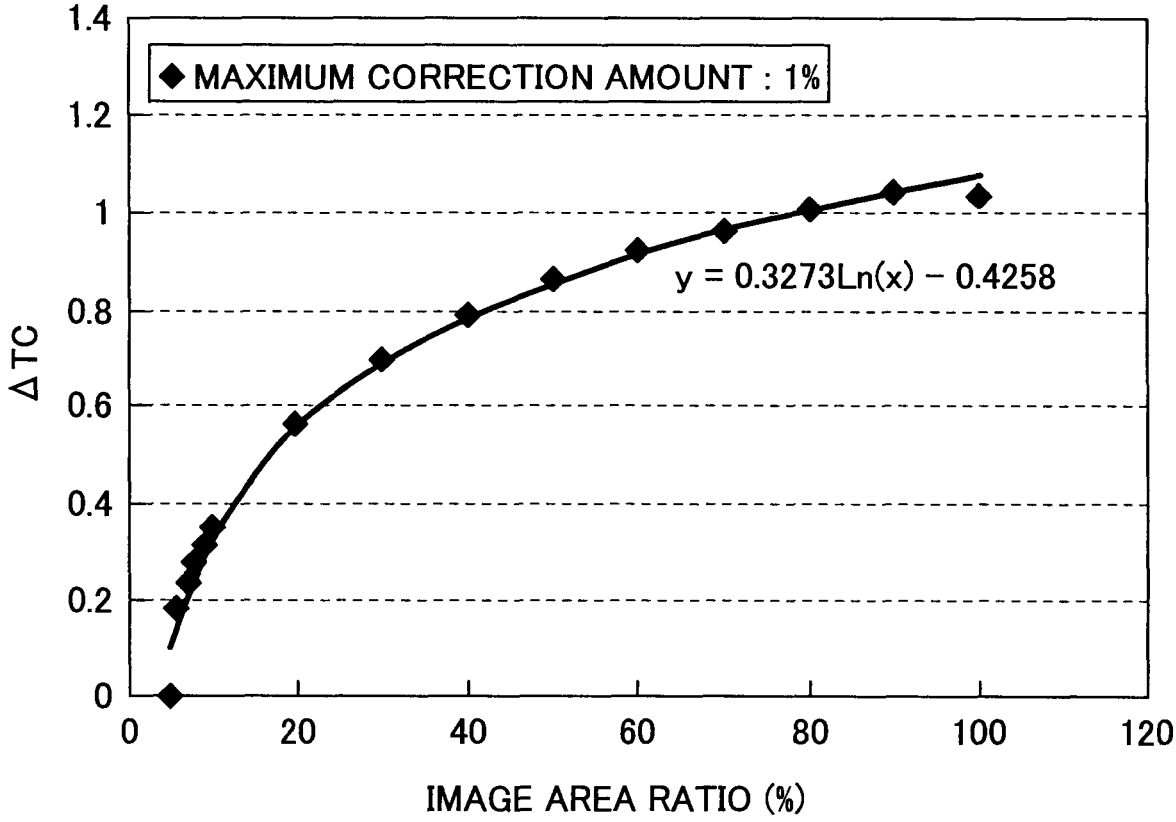
FIG. 9 is a graph having a horizontal axis representing the image area ratio moving average and a vertical axis representing the amount of toner density correction to be made with respect to the toner density of a reference toner pattern in order to maintain the development γ to a fixed level.

FIG. 9 is a graph having a horizontal axis representing the image area ratio moving average value (%) and a vertical axis representing the toner density correction amount (wt %) by which the toner density is to be changed in the negative direction for maintaining the development γ to a fixed level according to a reference toner density.

According to this graph, when the image area moving average value is 80%, the development γ may be maintained constant by controlling the toner density correction amount to be ΔTC=1 so that the toner density may be changed by −1 wt %. The toner density correction amount ΔTC with respect to the image area ratio moving average value of the image coverage ratio can be approximated most precisely by logarithm approximation. For this reason, the toner density correction amount ΔTC with respect to the average moving value employed in the LUT is determined employing the method of logarithmic approximation. In the present example, as shown in Table 1, the correction step is implemented in 1% increments when the moving average value is less than 10%, and the correction step is implemented in 10% increments when the moving average value is 10% or greater. The correction step is able to be altered as is desired in accordance with the characteristics of the developer and the developing apparatus.

In addition, because the usage conditions of the developer are different for each color, various conditions, including the correction step and the execution timing of the target output value correction process, may vary for each developing apparatus 20. It is particularly desirable that the maximum correction amount be adjusted for each color. In this case, for example, the following formula (4) may be used instead of the above formula (3):

$$\Delta Vt_{ref} = (-1) \times \Delta TC \times a \times (\text{Sensitivity of Magnetic Permeability Sensor 26}) \times (\text{Color Correction Coefficient}) \quad (4)$$

After the correction amount $\Delta Vt_{ref}$ is determined by referring to the LUT in the manner described above (step S7), the control unit 100 calculates for each color a corrected target output value $Vt_{ref}$ from the determined correction amount $\Delta Vt_{ref}$ and the initial value of the $\Delta Vt_{ref}$ acquired from step S2 based on the following formula (5) (step S8):

$$(\text{Corrected } Vt_{ref}) = (\text{Initial Value of } Vt_{ref}) + \Delta Vt_{re} \quad (5)$$

Next, the control unit 100 executes upper/lower limit processing operations on the corrected $Vt_{ref}$ (step S9). Specifically, when the corrected $Vt_{ref}$ calculated from the above formula (5) exceeds an upper limit value that is determined beforehand, the upper limit value is assumed to be the corrected $Vt_{ref}$ (i.e., the corrected $Vt_{ref}$ calculated in step S8 is further corrected to the upper limit value). On the other hand, when the corrected $Vt_{ref}$ calculated from the above formula (5) falls below a lower limit value that is determined beforehand, this lower limit value is assumed to be the corrected $Vt_{ref}$ (i.e., the corrected $Vt_{ref}$ calculated in step S8 is further corrected to the lower limit value). Moreover, when the corrected $Vt_{ref}$ calculated in step S8 is between the upper limit value and the lower limit value, the corrected $Vt_{ref}$ is not changed. After performing the upper/lower limit processing, the resulting corrected $Vt_{ref}$ is stored in the RAM 103 as the current value of the target output value $Vt_{ref}$ (step S10).

It is noted that in the case where successive printing is performed, the above-described target output value correction process is preferably executed during the interval from the time a last developing process is completed to the time the present developing process is to start. By performing the output value correction process at such execution timing, toner density control using a target output value that is suitably corrected with respect to each output image even during successive printing operations, for example.

In the following, the target output value correction process performed by the second target output value correction unit is described.

Figure 10:
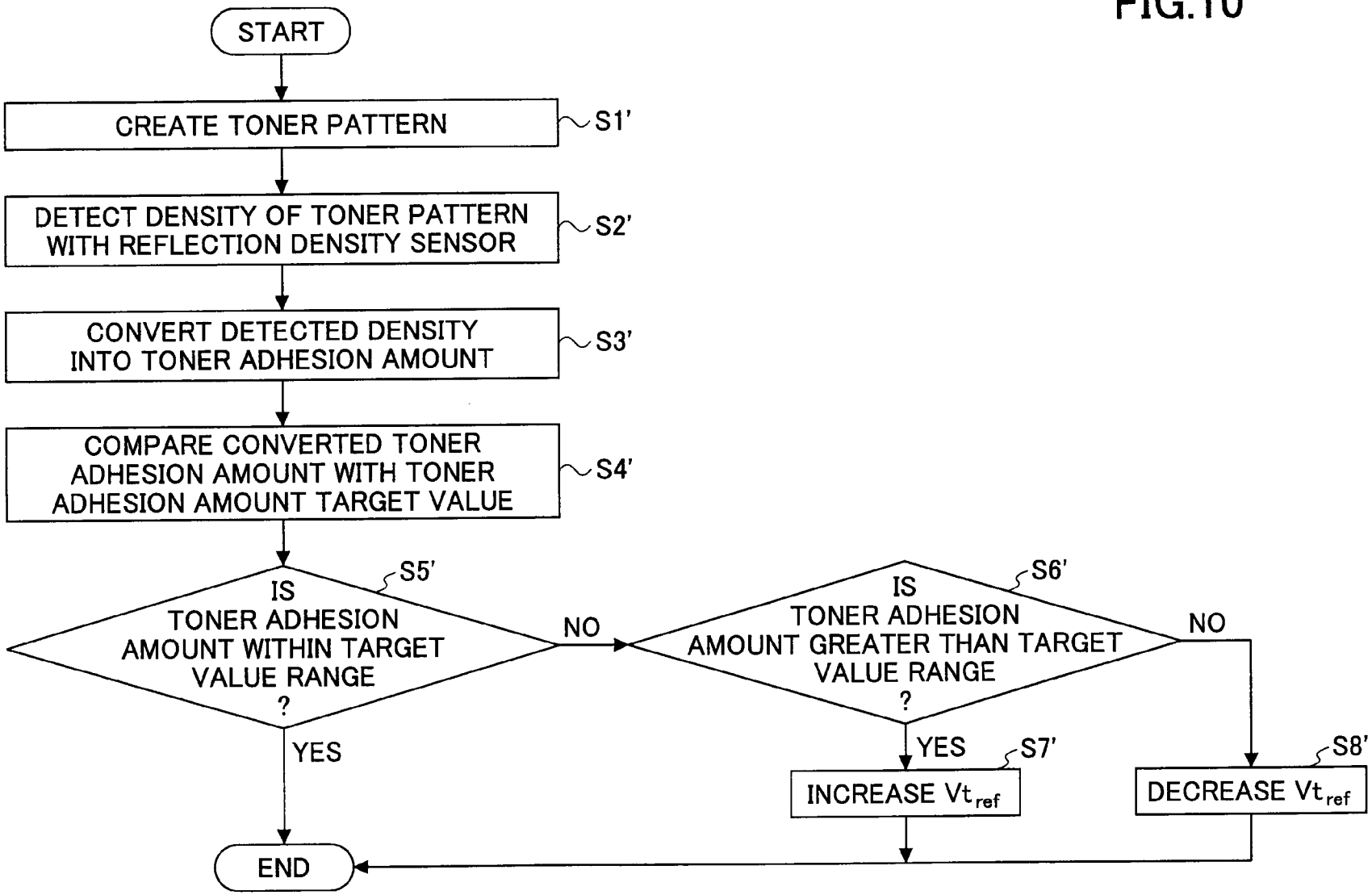
FIG. 10 is a flowchart showing process steps of a target output value correction process performed by a second target output value correction unit.

FIG. 10 is a flowchart illustrating exemplary process steps of a target output value correction process performed by the second output value correction unit. According to this flowchart, first, a reference toner pattern is created on a section of the intermediate transfer belt 6 in between image regions for two adjacent sheets (step S1'). In the present example, the reference toner pattern to be created is 12 mm in the main scanning direction and 15 mm in the sub scanning direction. Also, it is noted that in the present example, a solid pattern is used as the reference pattern; however, other types of relatively stable patterns such as a 2 by 2 pattern may also be used to accurately detect the developing capacity. As for the developing bias, a fixed developing bias may be used or an image portion bias calculated in a previous potential process control may be used. Also, the developing bias may be lowered in order to reduce the amount of tone used for detection. Next, the toner density of the toner pattern is detected by the reflection density sensor 62 (step S2'). It is noted that the reflection density sensor 62 includes a light emitting part and a light receiving part and is configured to irradiate LED light from the light emitting part on the reference toner pattern created on the intermediate transfer pattern 6 and detect reflection light of the toner pattern with a phototransistor of the light receiving part. As for the reflection light, a regular reflection light is used for detecting a black toner pattern, and diffuse reflection light is used for detecting magenta, cyan, and yellow color toner patterns. Next, the toner density of the reference toner pattern in each color is converted into a corresponding toner adhesion amount (step S3'). As for the conversion process, for example, a conversion table indicating the correspondence between the detected intensity of the reflection light and the toner adhesion amount may be prepared beforehand, and the toner density may be converted into a corresponding toner adhesion amount according to this conversion table. Next, a toner adhesion amount target value $M_{target}$ and the calculated toner adhesion amount M are compared (step S4'). In the present example, it is assumed that the toner adhesion amount target value $M_{target}$ for the reference toner patterns in the colors magenta, cyan, and yellow is $0.4\pm0.4$ (mg/cm$^2$) and the toner adhesion amount target value $M_{target}$ for the black toner pattern is $0.3\pm0.3$ (mg/cm$^2$). It is noted that since regular reflection is used for detecting the black toner pattern, detection may not be adequately performed in a high toner adhesion amount region, and thus, detection is performed at a lower toner adhesion amount region for black toner pattern detection.

Next, a determination is made as to whether the toner adhesion amount M of the reference toner pattern in each color is within its corresponding target value range (step S5'). If the toner adhesion amount M is within the target value range (step S5', Yes), the target output value correction process by the second target output value correction unit is ended without changing the target output value $Vt_{ref}$. If the toner adhesion amount M does not fall within the corresponding target value range, a determination is made as to whether the toner adhesion amount M is greater than the target value range (step S6'). If it is determined that the toner adhesion amount M is greater than the target value range (step S6', Yes), the target output value $Vt_{ref}$ is increased (step S7') so that the toner density may be decreased after which the output value correction process is ended. If it is determined that the toner adhesion amount M is less than the target value range (step S6', No), the target output value $Vt_{ref}$ is decreased (step S8') so that the toner density may be increased after which the output value correction process is ended.

In the case of performing a target output value correction process using the second target output value correction unit, accuracy may be improved by increasing the frequency of creating the reference toner patterns. However, toner consumption is increased when the reference toner patterns are frequently created. Thus, it is difficult to increase the frequency of creating the reference toner patterns from an environmental standpoint.

On the other hand, when the frequency at which the reference toner patterns are created are simply reduced, by the time the reference toner patterns are created for executing toner density control (target output value correction) by the second target output value correction unit, the toner density of the reference toner pattern created may have already deviated from the desired toner density. This means that the image densities of images output in between intervals of creating the reference toner patterns are not accurately controlled at a fixed level.

Accordingly, the above-described first target output value correction unit is used in the present example so that the target output value may be corrected with respect to every image output. In this way, image density stability of output images may be improved. However, it is noted that further improvements are desired with respect to control operations executed by the first target value correction unit.

First, in the target output value correction process performed by the first output value correction unit, the correction amount has to be limited to a relatively small amount in order to prevent overcorrection so that there may be cases in which the image density cannot be adequately corrected by the first output value correction unit. Second, the first output value correction unit may not be capable of adequately correcting the image density in response to a sudden change such as a sudden environmental change or a sudden change in the image output mode. Third, the first output value correction unit corrects the image density based on a change in the image area ratio (toner exchange amount) of output images; however, the image density may change even when there is no change in the image area ratio (toner exchange amount); that is, the image density may change due to external factors such as environmental change or time lapse, for example. Thus, in a preferred embodiment of the present invention, feedback measures are implemented in the first target output value correction unit in order to address the above described problems.

Specifically, in the target output value correction process by the first output value correction unit that corrects the target output value based on the image area ratio as is described above, parameters are prone to change from the operation starting point. Therefore, errors may occur from parameter detection and machine tolerance, for example. In turn, such errors may cause errors in the control operations by the first output value correction unit. Also, the first output value correction unit does not have adequate measures for responding to external factors such as environmental change or time lapse, for example. Accordingly, in the case of correcting the target output value $Vt_{ref}$ by the first target output value correction unit, the amount of movement of a parameter to be changed has to be limited to a small amount in order to prevent overcorrection. Thus, it has been rather difficult to adequately control the image density of output images through control operations by the first output value correction unit. That is, even when target output value correction processes are performed by the first output value correction unit within the intervals of creating the reference toner patterns, the image density of the output images may not necessarily be controlled at a fixed level as is desired.

In view of such a problem, according to an embodiment of the present invention, the control unit 100 may function as a parameter modifying unit that is configured to modify the parameter (a) used by the first target output value correction unit to calculate the target output value $Vt_{ref}$. Specifically, the parameter modifying unit modifies the parameter (a) based on detection results obtained by the reflection density sensor 62 upon detecting the image densities of the reference toner patterns created in the target output value correction process by the second target output value correction unit as is described above. In this way, the detection results obtained by the reflection density sensor 62 upon detecting the image densities of the reference toner patterns may be reflected in the correction of the target output value $Vt_{ref}$ by the first target output value correction unit as feedback. Also, according to the present embodiment, the parameter (a) is modified according to the image density of an image that is actually formed so that the target output value $Vt_{ref}$ corrected by the first target output value correction unit using the modified parameter (a) may adequately reflect the effects of sudden environmental change or a sudden change in the image output mode, for example. In this way, the image density of output images may be accurately controlled to a fixed level by performing target output value correction by the first target output value correction unit within the intervals of creating reference toner patterns.

In the following, three specific embodiments of parameter modifying units are illustrated.

Embodiment 1

First, a parameter modifying unit according to a first embodiment of the present invention is described.

Figure 11:
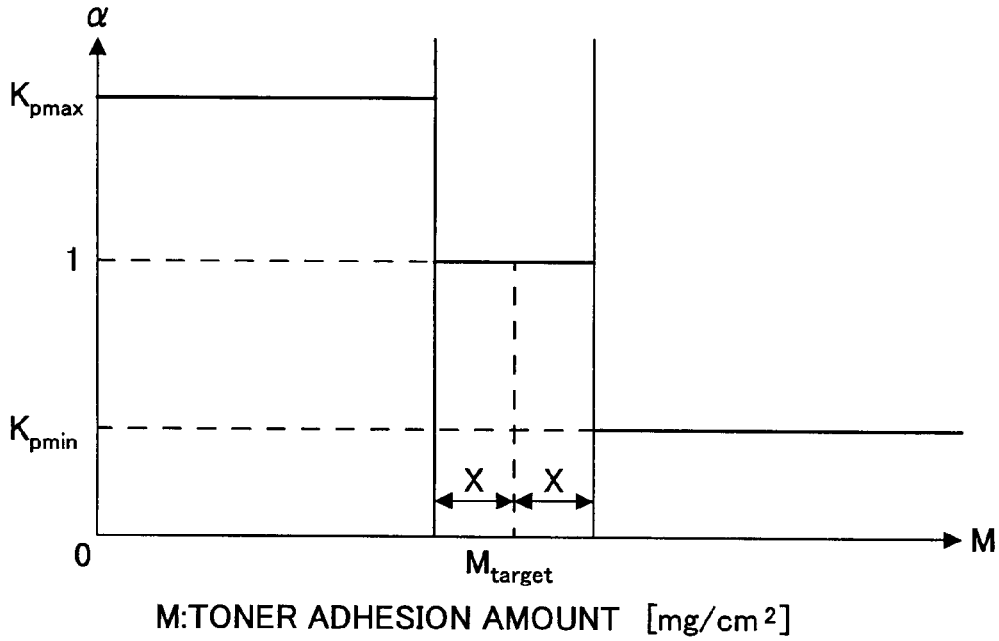
FIG. 11 is a graph illustrating control operations of a parameter modifying unit of a first embodiment of the present invention for adjusting a parameter value according to a toner adhesion amount.

FIG. 11 is a graph showing the relationship between the parameter (a) and the toner adhesion amount M of a reference toner pattern according to the first embodiment.

A parameter modifying process by the parameter modifying unit according to the first embodiment is based on comparison results obtained by the second target output value upon comparing the toner adhesion amount M calculated based on the toner density of the reference pattern of each color and its corresponding toner adhesion amount target value $M_{target}$. As is shown in FIG. 11, if the toner adhesion amount M of a reference toner pattern is within a target value range (i.e., $M_{target}-X<M<M_{target}+X$), the parameter (a) is set to 1. If the toner adhesion amount M is greater than the target value range (i.e., $M_{target}+X<M$), the parameter (a) is set to a minimum correction value $Kp_{min}$. On the other hand, if the toner adhesion amount is less than the target value range (i.e., $M<M_{target}-X$), the parameter (a) is set to a maximum correction value $Kp_{max}$.

Embodiment 2

In the following, a parameter modifying unit according to a second embodiment of the present invention is described.

Figure 12:
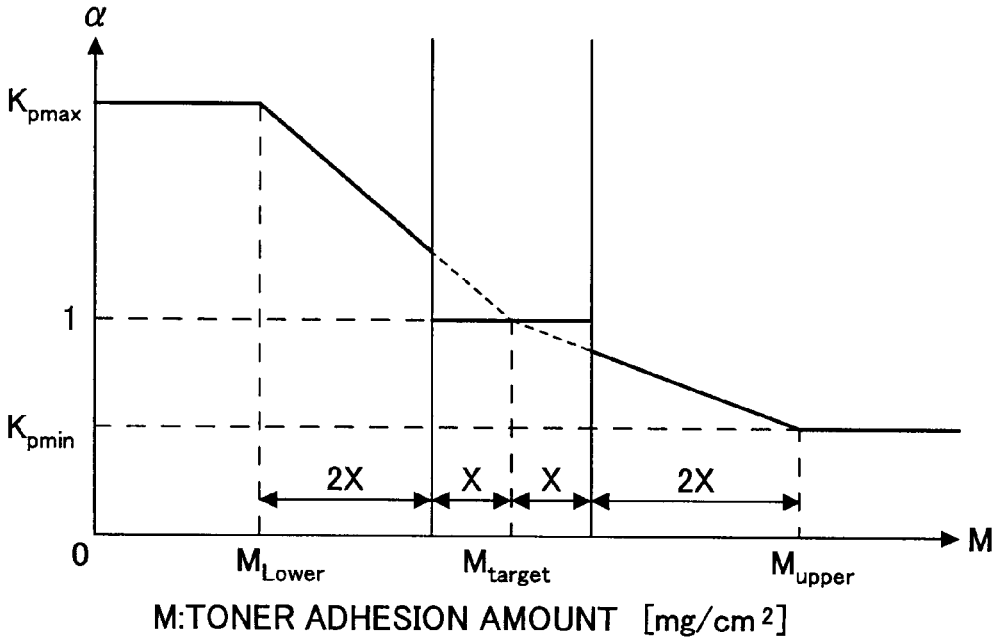
FIG. 12 is a graph illustrating control operations of a parameter modifying unit according to a second embodiment of the present invention for adjusting a parameter value according to a toner adhesion amount.

FIG. 12 is a graph showing the relationship between the parameter (a) and the toner adhesion amount M of a reference toner pattern according to the second embodiment. As can be appreciated from FIG. 12, the parameter modifying unit according to the second embodiment is configured to enable finer adjustment of the parameter (a) compared to the parameter modifying unit according to the first embodiment.

Table 2 as is shown below indicates the relationship between the toner adhesion amount M and the parameter (a) according to the second embodiment.

TABLE 2

| Toner Adhesion Amount Condition | Correction Parameter (a) |
|---|---|
| $M < M_{lower}$ | $K_{pmax}$ |
| $M_{lower} \leqq M < M_{target} - X$ | $\frac{1 - K_{pmax}}{M_{target} - M_{lower}}(M - M_{target}) + 1$ |
| $M_{target} - X \leqq M \leqq M_{target} + X$ | 1 |
| $M_{target} + X < M \leqq M_{upper}$ | $\frac{1 - K_{pmin}}{M_{target} - M_{upper}}(M - M_{target}) + 1$ |
| $M_{upper} < M$ | $K_{pmin}$ |

As can be appreciated, the parameter modifying unit according to the second embodiment is capable of performing finer adjustment on the parameter (a) compared to the parameter modifying unit according to the first embodiment.

It is noted that FIG. 12 is merely one illustrative example of modifying the parameter (a) according to the second embodiment and other examples are possible as well.

Embodiment 3

In the following, a parameter modifying unit according to a third embodiment of the present invention is described.

The parameter modifying unit according to the third embodiment is configured to adjust the parameter (a) according to a target output value correction amount $\Delta Vt_{ref\text{-}2}$ that is calculated by the second target output value correction unit based on the toner adhesion amount M of a reference toner pattern and a target output value correction amount $\Delta Vt_{ref\text{-}1}$ that is stored in the RAM 103 and is obtained by the first target output value correction unit right before the present parameter modifying process is executed.

It is noted that since only a small amount of toner is consumed upon forming the reference toner pattern, there may be no substantial change in the developing capacity caused by toner exchange resulting from such pattern formation. Therefore, the toner exchange amount does not have to be taken into consideration in this case. Accordingly, if there is no change in the developing capacity caused by environmental change or some other external factor, the correction amounts $\Delta Vt_{ref\text{-}1}$ and $\Delta Vt_{ref\text{-}2}$ should be the same (i.e., $Vt_{ref\text{-}1}=\Delta Vt_{ref\text{-}2}$) It is noted that since the correction amount $\Delta Vt_{ref\text{-}2}$ is calculated based on the image density of an image (i.e., reference toner pattern) that is actually formed, the correction amount $\Delta Vt_{ref\text{-}2}$ may be more accurate than the correction amount $\Delta Vt_{ref\text{-}1}$, which is calculated based on the image area ratio (toner exchange amount) of an output image. Accordingly, when the correction amounts $\Delta Vt_{ref\text{-}1}$ and $\Delta Vt_{ref\text{-}2}$ are different, the parameter (a) is adjusted so that the correction amount $\Delta Vt_{ref\text{-}1}$ may equal the correction amount $\Delta Vt_{ref\text{-}2}$. That is, in the present embodiment, the parameter (a) may be calculated based on the ratio of $\Delta Vt_{ref\text{-}1}$ to $\Delta Vt_{ref\text{-}2}$ as is indicated by the following formula (6):

$$a=(\Delta Vt_{ref\text{-}2})/(\Delta Vt_{ref\text{-}1})$$

As can be appreciated from the above-described embodiments 1-3, by correcting the parameter (a) used by the first output value correction unit to calculate (correct) the target output value $Vt_{ref}$ based on the image density of a reference toner pattern that is created in a target output value correction process performed by the second output value correction unit, the image density of an image that is actually formed may be reflected in the correction of the target output value by the first target output value correction unit as feedback. In other words, a correction amount calculated based on the image area ratio may be corrected based on a detection result of the image density of an image that is actually formed. In this way, the first target output value correction unit may adequately respond to external factors such as environmental change or time lapse, and the correction capacity of the first target output value correction unit that corrects the target output value based on the image area ratio (toner exchange amount) may be expanded. Also, the execution frequency of the target output value correction process by the second target output value correction unit that corrects the target output value based on the image density of a reference toner pattern may be reduced without degrading the control performance level. As a result, the frequency at which the reference toner pattern is created may be reduced so that the amount of toner consumption may be reduced which may be a sales advantage for an image forming apparatus.

Also, in the present embodiment, a value obtained by multiplying the toner density correction amount ΔTC by the sensitivity of the magnetic permeability sensor 26 is multiplied by the parameter (a) as is shown in the above Formula (3) so that the image area ratio and the target output value correction amount $\Delta Vt_{ref}$ may be in an analogous relationship as is shown in the LUT of Table 1. It is noted that the LUT of Table 1 and the function of formula (3) are accurate representations of the relationship between the image area ratio and $\Delta Vt_{ref}$ obtained through extensive logical calculations and tests. Accordingly, by using the parameter (a) as a multiplier, the relationship between the image area ratio and the correction amount $\Delta Vt_{ref}$ obtained through tests and logical calculations may be accurately reflected in correction of the target output value $Vt_{ref}$.

In a preferred embodiment, the second target output value correction unit is used to check the control accuracy of the target output value correction process performed by the first target output value correction unit. Specifically, when degradation of the control accuracy of the target output value correction process by the first target output value correction process is detected, the parameter modifying unit is operated to correct the parameter (a) in order to restore the control accuracy of the first target output value correction unit. By controlling image forming performance in this manner, the amount of disposal toner generated as a result of creating reference toner patterns may be reduced while accurately maintaining the image density to a fixed level. For example, in a conventional application, control operations (correction process) by the second target output value correction unit that involve toner pattern formation are preferably performed for every image output of five pages, and more preferably for every image output of two pages, in order to adequately maintain the image density to a fixed level. However, according to an embodiment of the present invention, image density may be adequately maintained at a fixed level even when toner pattern formation is only performed for every image output of 10-50 pages, for example.

Also, when external factors such as environmental change have to be taken into consideration, the frequency at which toner patterns are formed may be increased so that the parameter modifying unit may be activated more frequently and the first target output value correction unit may receive feedback more frequently. For example, control measures may be implemented to increase the frequency of activating the parameter modifying unit when the image area ratio moving average value to be referenced from the LUT of Table 1 is less than 2(%) or greater than 60(%). Such control measures may be implemented in view of the fact that when the image area ratio of an output image is high, the image density may increase by an unexpected amount in response to environmental change or change over time, for example. Also, when the image area ratio of an output image is low, the image density may decrease by an unexpected amount in response to environmental change or change over time, for example. Therefore, the frequency at which the second target output value correction unit is to interfere with the control operations by the first target output value correction unit may be increased so that the frequency at which feedback from the parameter modifying unit is supplied to the first target output value correction unit may be increased. On the other hand, it is noted that the image density may be adequately maintained at a fixed level even when control measures are implemented to prolong the interval between correction processes performed by the second target output value correction unit when the image area ratio moving average value is around 5(%).

As can be appreciated from the above descriptions, according to an embodiment of the present invention, the toner density as one image density control condition is adjusted (changed) to a suitable value to stabilize the toner charge level so that the output image density may be stabilized. However, there may be cases in which the toner density is changed to an extremely low level or an extremely high level upon being exposed to certain environments such as a low-temperature low-humidity environment or high-temperature high-humidity environment, or upon successively outputting a large number of high image area ratio images or low image area ratio images, for example. In such cases, toner scattering or screw pitch irregularities may occur and abnormal images may be output, for example.

In view of such a problem, according to an embodiment of the present invention, upper/lower limit processing is performed on the corrected target output value $Vt_{ref}$ that is obtained through calculation as is described above. Specifically, if the corrected target output value $Vt_{ref}$ exceeds an upper limit value that is determined beforehand, the upper limit value is assumed to be the corrected target output value $Vt_{ref}$. On the other hand, if the corrected target output value $Vt_{ref}$ falls below a lower limit value that is determined beforehand, the lower limit value is assumed to be the corrected target output value $Vt_{ref}$. It is noted that although abnormal images with toner scattering and screw pitch irregularities may be prevented from being output by performing such upper/lower limit processing, this may result in degradation in the stability of the output image density.

In this respect, according to an embodiment of the present invention, when the corrected target output value $Vt_{ref}$ exceeds the upper limit value to thereby be further corrected to this upper limit value, or when the corrected target output value $Vt_{ref}$ falls below the lower limit value to thereby be further corrected to this lower limit value, the control unit 100 may function as an auxiliary image density control condition adjusting unit that adjusts an image density control condition other than the toner density such as the developing bias or the laser beam output parameter (auxiliary image density control condition). Specifically, the CPU 101 of the control unit 100 may execute a predetermined program to perform an auxiliary image density control condition adjusting process.

Figure 13:
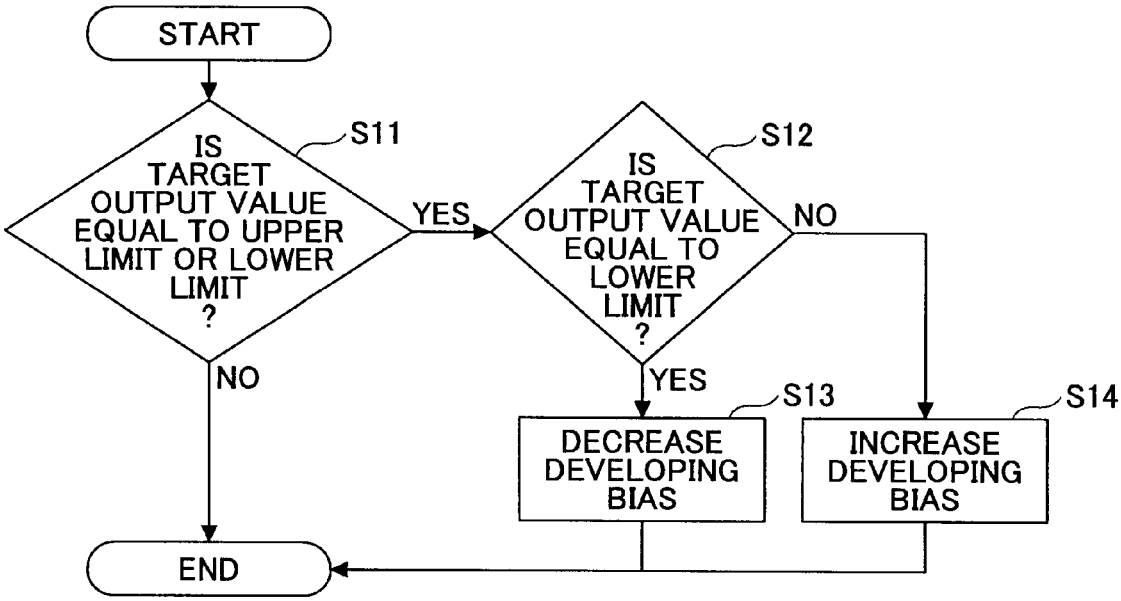
FIG. 13 is a flowchart illustrating process steps of a developing bias adjusting process performed by an auxiliary image density control condition adjusting unit.

FIG. 13 is a flowchart illustrating process steps of a developing bias adjusting process that is performed by the auxiliary image density control condition adjusting unit according to an embodiment of the present invention.

As is shown in this drawing, first, the control unit 100 determines whether the target output value $Vt_{ref}$ is set to the upper limit value or the lower limit value as a result of the upper/lower limit processing (step S11). In the present example, it is assumed that the lower limit value for the toner density is 5 (wt %), and the upper limit value for the toner density is 8 (wt %). If the target output value $Vt_{ref}$ is not set to the upper limit value or the lower limit value (step S11, No), the present process is ended.

On the other hand, if the target output value $Vt_{ref}$ is set to the upper limit value or the lower limit value (step S11, Yes), a determination is made as to whether the target output value $Vt_{ref}$ is set to the lower limit value (step S12). When the target output value $Vt_{ref}$ is set to the lower limit value (step S12, Yes), this means that the corrected target output value $Vt_{ref}$ obtained through calculation is lower than the lower limit value, and accordingly, the developing bias is decreased by a predetermined amount (step S13).

When the target output value $Vt_{ref}$ is set to the upper limit value (step S12, No), this means that the corrected target output value $Vt_{ref}$ obtained through calculation is higher than the upper limit value, and accordingly, the developing bias is increased by a predetermined amount (step S14).

It is noted that a sudden change in the developing bias may cause a sudden change in the output image density. Accordingly, the developing bias is preferably changed gradually in number of stages. For example, when the target output value $Vt_{ref}$ is set to the lower limit value, the developing bias may be lowered 10 (V) at a time for every image output of 10 pages until the target output value $Vt_{ref}$ becomes greater than a predetermined value of 6 (wt %). It is noted that the above lower limit value of 5 (wt %), the upper limit value of 8 (wt %), the predetermined value of 6 (wt %), and the developing bias change of 10 (V) are exemplary values may be adjustably set depending on the type of developer used or the machine configuration, for example. Also, it is noted that although the developing bias is being adjusted in the above-described example, the laser beam output parameter may be subject to adjustment by the auxiliary image density control condition adjusting unit in another example.

COMPARATIVE EXAMPLES

In the following, an exemplary case of performing target output value correction process operations according to an embodiment of the present invention is described in relation to comparative examples.

Figure 14:
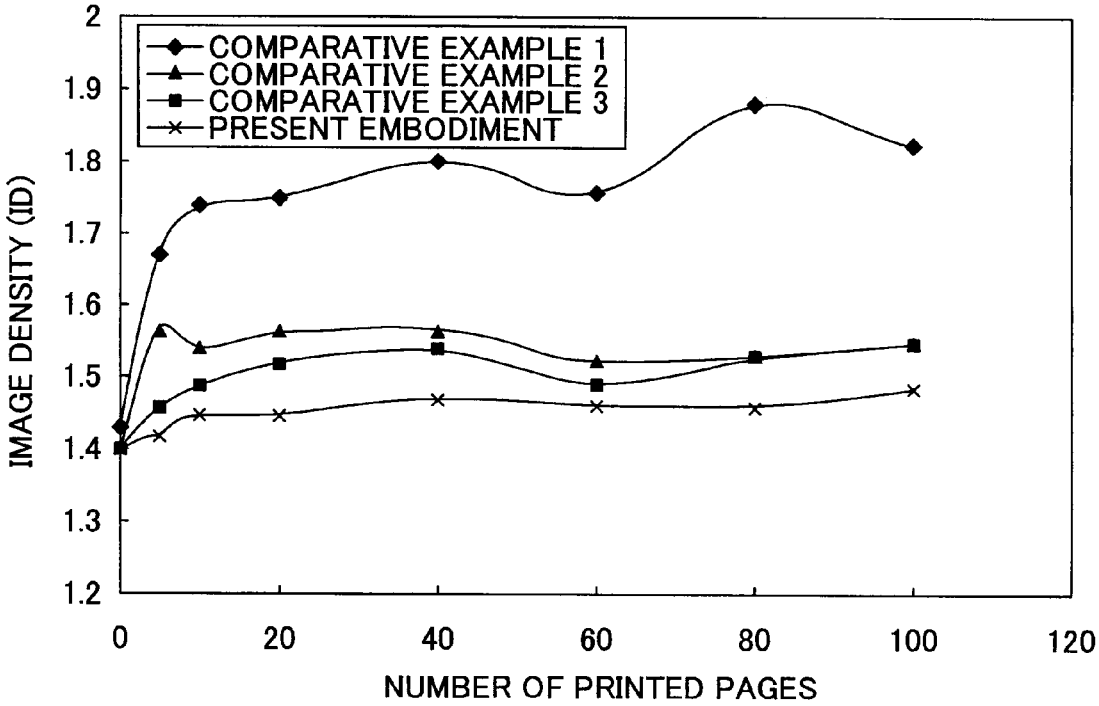
FIG. 14 is a graph showing output image densities resulting from performing control operations according to an embodiment of the present invention and control operations according to comparative examples.

FIG. 14 is a graph illustrating output image density detection results obtained in the case of implementing control operations according to the present embodiment and comparative examples where such control operations are not performed.

In the comparative examples, output image densities have been detected upon successively forming 100 pages of solid images with an image area ratio of 70% in standard line speed mode (138 mm/s) using a laser printer. Specifically, in Comparative Example 1, target output value correction processes by the first target output value correction unit and the second target output value correction unit are not performed so that the image density ID increases in accordance with the progress of the successive image forming operations (i.e., the image density increases as the number of pages of images printed increases). In Comparative Example 2, the target output value correction process by the second target output value correction unit is performed after every image output of several pages. In this case, the image density ID increases by a substantial amount before being corrected so that there is a certain time period in which the image density ID is at a high level. In Comparative Example 3, target output value correction is performed only using the first target output value correction unit. In this case, the image density may be prevented from significantly increasing since target output value correction is performed from the beginning. However, the image density ID is rather unstable and is prone to increase or decrease at certain points. On the other hand, in the present embodiment as is illustrated in FIG. 14, target output value correction processes by the first and second target output value correction unit are performed, and the parameter used by the first target output value correction unit is modified by the parameter modifying unit so that the image density ID may be maintained at a substantially fixed level even when a large number of pages are successively printed, for example. In the present embodiment, the calculation formula used by the first target output value correction unit for performing fine correction on the target output value $Vt_{ref}$ with respect to image output of each page may be modified in accordance with influences of external factors at a timing corresponding to the execution timing of target output value correction operations by the second target output value correction unit (e.g., after every image output of several to several dozen pages). In other words, in the present embodiment, the first target output value correction unit may correct the target output value $Vt_{ref}$ in consideration of a change in the toner charge level due to a change in the toner exchange amount as well as a change in the toner charge level due to external influences such as environmental change.

Thus, in consideration of the above comparative examples, it can be appreciated that by controlling image forming operations through target output value correction process operations according to the present embodiment, improvements may be made with regard to maintaining image density stability upon outputting images that require a large amount of toner exchange, namely, images that have a high image area ratio.

It is noted that in the above-described embodiments of the present invention, the toner density is subject to the target output value correction process by the first target output value correction unit. However, the present invention is not limited to such embodiments, and in other embodiments, the developing bias may be subject to correction the target output value correction process by the first target output value correction unit. In this case, the toner density and the laser output parameter may be fixed to values adjusted by the potential control unit, and the first target output value correction unit may be configured to correct a target value for the developing bias. The control unit 100 may control the developing bias source 105 corresponding to a developing electric field generating unit so that the developing bias may be substantially equal to its corresponding target value.

It is noted that when the developing bias target value is too low, a desired image density may not be obtained even when the developing bias is set to the target value. Also, when the developing bias target value is too high, the developing bias may exceed the tolerated voltage of the developing bias source 105 to thereby cause damage or breakdown, for example. In view of such problems, upper and lower limit values may be set to the developing bias target output value, and when the developing bias target value calculated from a predetermined calculation formula is less than the lower limit value, the lower limit value may be assumed to be the developing bias target value and image density control conditions other than the developing bias such as the toner density target output value may be corrected accordingly, for example. On the other hand, when the developing bias target value calculated from the predetermined formula is greater than the upper limit value, the upper limit value may be assumed to be the developing bias target value and image density control conditions other than the developing bias such as the toner density target output value may be corrected accordingly, for example.

In another embodiment, the laser output parameter may be subject to the target output value correction process by the first target output value correction unit.

Also, it is noted that in the above-described embodiments, the first target output value correction unit calculates the target output value $Vt_{ref}$ based on the image area ratio moving average of output images; however, the present invention is not limited to such embodiments. For example, the target output value $Vt_{ref}$ may be calculated based on the moving average of values obtained by dividing the image area ratio of each image output over a predetermined period (e.g., the past several to several dozen pages of images printed up to the present moment) by the developing apparatus drive time over the predetermined period. Such measures may be implemented in view of the fact that even when images with the same image area ratio are successively printed, the condition of the developer may vary depending on the printing job execution time interval, for example. That is, in successive image printing, the developing apparatus continues to be driven even during the interval between two consecutive printing jobs. Thus, by divining the image ratio of each image output over a predetermined period by the developing apparatus drive time over the predetermined period differences in the condition of the developer caused by differences in the printing job execution interval may be absorbed.

Also, it is noted that in the above-described embodiments of the present invention, an intermediate transfer type laser printer is used; however, the present invention is not limited to such embodiments, and in other alternative embodiments, a direct transfer type image forming apparatus may be used that is configured to transfer a toner image formed on a photoconductor 11 directly onto transfer paper that is carried by a transfer belt, for example. In this case, during successive image printing, a toner pattern may be formed on a section of the transfer belt between the rear edge of a first page being carried by the transfer belt and the front edge of a second page following the first page.

According to an aspect of the present invention, a first target output value correction unit as an image density control condition modifying unit calculates a target output value for a toner density corresponding to one image density control condition based on a predetermined parameter (a) and the amount of toner exchanged at a developing apparatus within a predetermined period, and adjusts the toner density to be substantially equal to the calculated target output value. Further, the above parameter (a) is modified by a parameter modifying unit based on detection results obtained by a reflection density sensor 62 as a toner pattern detection unit that detects a toner pattern formed on an intermediate transfer belt as a belt member. By performing target output value correction operations of the first target output value correction unit, image density fluctuations caused by external influences such as environmental change as well as image density fluctuations caused by fluctuations in the toner exchange amount may be suppressed so that the output image density may be stabilized.

According to another aspect of the present invention, when the toner density target output value calculated by the first target output value correction unit is greater than an upper threshold value that is determined beforehand or is less than a lower threshold value that is determined beforehand, an auxiliary image density control condition adjusting unit may adjust an image density control condition other than the toner density such as the developing bias or the laser beam output parameter. In this way, the generation of abnormal images may be prevented and the image density may be further stabilized.

According to another aspect of the present invention, the intervals at which the control processes by the first target output value correction unit are executed and the intervals at which control processes by the parameter modifying unit are executed are arranged to differ. Such arrangement is implemented in view of the fact that although the amount of toner exchanged at the developing apparatus changes each time an image is output, a change in external influences such as the environment is not the result of an image output and is rather cause by other various factors. Thus, although the control process by the first target output value correction unit is preferably performed with respect to every image output, the control process by the parameter modifying unit may be performed at the time environmental change or some other external disturbance occurs. By varying the execution interval of the control process by the first target output value correction unit and the execution interval of the control process by the parameter modifying unit, the toner consumption amount may be reduced while maintaining image density stability.

It is particularly noted that the execution interval of the control process by the parameter modifying unit is preferably arranged to be longer than the execution interval of the control process by the first target output value correction unit so that the toner consumption amount may be reduced while maintaining image density stability.

According to another aspect of the present invention, by arranging the parameter (a) to be a one-degree-of-freedom parameter, the parameter (a) may be modified through simple control operations compared to a case where the degree of freedom is two or more.

According to another aspect of the present invention, as in the third specific embodiment described above, the parameter (a) may be modified based on a ratio of a target output value correction amount $\Delta Vt_{ref\text{-}1}$ that is calculated by the first target output value correction unit to a target output value correction amount $\Delta Vt_{ref\text{-}2}$ that is calculated based on the image density of a reference toner pattern. It is noted that since the target output value correction amount $\Delta Vt_{ref\text{-}2}$ is calculated based on the image density of an image that is actually formed, it may be more accurate than the target output value correction amount $\Delta Vt_{ref\text{-}1}$ that is calculated based on the image area ratio (toner exchange amount). Thus, by arranging the parameter (a) to correspond to the ratio of the target output value correction amount $\Delta Vt_{ref\text{-}1}$ to the target output value correction amount $\Delta Vt_{ref\text{-}2}$, the target output value correction amount $\Delta Vt_{ref\text{-}1}$ that is calculated based on the image area ratio may be adjusted to the target output value correction amount $\Delta Vt_{ref\text{-}2}$ that is calculated based on the image density of a reference toner pattern. In this way, the first target output value correction unit may be able to calculate a more accurate target output value.

According to another aspect of the present invention, the first target output value correction unit may modify the target output value $Vt_{ref}$ based on the moving average of image area ratios of images formed over a predetermined period that is obtained based on detection results acquired by the control unit 100. In this way, information on toner exchange amounts for the past several to several dozen pages of image outputs may be acquired so as to accurately determine the present condition of the developer. As a result, the target output value $Vt_{ref}$ may be more accurately corrected.

According to another aspect of the present invention, the target output value $Vt_{ref}$ may be calculated based on the moving average of values obtained by dividing the image area ratio (%) of each image output over a predetermined period by the developing apparatus drive time over the predetermined period. In this way, differences in the toner charge level within the developing apparatus caused by differences in the printing job execution interval may be absorbed.

It is particularly noted that by calculating a moving average value M(i) using the above-described formula (1), the storage area to be used in the RAM 103 may be substantially reduced.

According to another aspect of the present invention, the first target output value correction unit may be configured to refer to detection results acquired by the control unit 100 to adjust the target output value $Vt_{ref}$ so that the toner density may be decreased in the case where the amount of toner exchanged at a developing apparatus 20 within a predetermined period is greater than a reference toner exchange amount, and adjust the target output value $Vt_{ref}$ so that the toner density may be increased in the case where the amount of toner exchanged at the developing apparatus 20 within the predetermined period is less than a reference toner exchange amount. In this way, when images with a high image area ratio are output to cause an increase in the developing capacity and the development $\gamma$, for example, the target output value $Vt_{ref}$ may be easily and accurately corrected accordingly.

According to another aspect of the present invention, the execution interval of the control process by the parameter modifying unit may be changed according to the toner exchange amount, namely, the image area ratio. For example, an image area ratio cumulative average of 60(%) may be set as a first threshold value (upper threshold value), and an image area ration cumulative average of 2(%) may be set as a second threshold value (lower threshold value). When the cumulative average of image area ratios of images output within a predetermined time is greater than the first threshold value or less than the second threshold value, the intervals at which reference toner patterns are created may be controlled to be shorter than the case in which the image area ratio average is within the range of 2-60(%). Such control measures may be implemented in view of the fact that the image density may unexpectedly increase due to environmental change or degradation over time when the image area ratio is relatively high. Also, when the image area ratio is relatively low, the image density may unexpectedly decrease. Thus, in such cases, measures are preferably implemented to increase the frequency in which reference toner patterns are created so that correction processes on the target output value $Vt_{ref}$ may be performed by the second target output value correction unit more frequently. On the other hand, when the image area ratio of output images is around 5%, the intervals at which reference toner patterns are created may be arranged to be relatively long and the frequency at which the correction processes on the target output value $Vt_{ref}$ are performed by the second output value correction unit may be decreased since the image density may be adequately maintained at a fixed level in such a case.

Although the present invention is shown and described with respect to certain preferred embodiments, it is obvious that equivalents and modifications may occur to others skilled in the art upon reading and understanding the specification. The present invention includes all such equivalents and modifications, and is limited only by the scope of the claims.

The present application is based on and claims the benefit of the earlier filing date of Japanese Patent Application No. 2006-338006 filed on Dec. 15, 2006, the entire contents of which are hereby incorporated by reference.

What is claimed is:

1. An image forming apparatus comprising:

an image carrier that supports a latent image;

a latent image forming unit that forms the latent image on the image carrier;

a developing apparatus that develops the latent image formed on the latent image carrier into a toner image using a developer including toner and a magnetic carrier;

an image density control unit that performs control operations based on an image density control condition that is adjustably set to control an output image to have a predetermined image density;

a belt member that is arranged to be in contact with the image carrier and is suspended in a tensioned state by a plurality of support members;

a toner pattern detection unit that detects a toner pattern formed on the belt member;

an information detection unit that detects information for determining an amount of toner exchanged between the developing apparatus and the image carrier within a predetermined period, the information detection unit detecting image area ratios of a plurality of images formed within the predetermined period;

an image density control condition modifying unit that calculates a modified image density control condition based on the information detected by the information detection unit and a parameter for image density control condition calculation and sets the modified image density control condition as the image density control condition to be used by the image density control unit; and a parameter modifying unit that modifies the parameter for image density control condition calculation used by the image density control condition modifying unit based on a detection result obtained by the toner pattern detection unit, wherein the image density control condition modifying unit calculates the modified image density control condition based on a moving average of the image area ratios detected by the information detection unit.

2. The image forming apparatus as claimed in claim 1, further comprising:

an auxiliary image density control condition adjusting unit that adjusts an auxiliary image density control condition when the modified image density control condition calculated by the image density control condition modifying unit is greater than a predetermined upper limit threshold value or is less than a predetermined lower limit threshold value, the auxiliary image density control condition being different from the image density control condition modified by the image density control condition modifying unit.

3. The image forming apparatus as claimed in claim 2, wherein the auxiliary image density control condition that is adjusted by the auxiliary image density control condition adjusting unit corresponds to a developing bias.

4. The image forming apparatus as claimed in claim 2, wherein the auxiliary image density control condition that is adjusted by the auxiliary image density control condition adjusting unit corresponds to an output parameter used by the latent image forming unit to form the latent image on the image carrier.

5. The image forming apparatus as claimed in claim 1, wherein a process execution interval of the image density control condition modifying unit is different from a process execution interval of the parameter modifying unit.

6. The image forming apparatus as claimed in claim 5, wherein the process execution interval of the parameter modifying unit is longer than the process execution interval of the image density control condition modifying unit.

7. The image forming apparatus as claimed in claim 1, wherein the parameter for image density control condition calculation used by the image density control condition modifying unit is a one-degree-of-freedom parameter.

8. The image forming apparatus as claimed in claim 1, wherein the parameter modifying unit modifies the parameter for image density control condition calculation used by the image density control condition modifying unit based on a ratio between a first image density control condition correction amount calculated by the image density control condition modifying unit and a second image density control condition correction amount calculated by the toner pattern detection unit.

9. The image forming apparatus as claimed in claim 1, wherein the moving average, denoted as M(i), is calculated based on the following formula:

$$M(i)=(1/N)\times\{M(i-1)\times(N-1)+X(i)\}$$

wherein 'N' denotes a sampling number of the image area ratios, 'M(i−1)' denotes a previously calculated moving average, and 'X(i)' denotes a most recent image area ratio detection result obtained by the information detection unit.

10. The image forming apparatus as claimed in claim 1, wherein the information detection unit detects values calculated by dividing image area ratios of images formed within the predetermined period by a drive time of the developing apparatus within the predetermined period; and the image density control condition modifying unit calculates the modified image density control condition based on a moving average of the values detected by the information detection unit.

11. The image forming apparatus as claimed in claim 10, wherein the moving average, denoted as M(i), is calculated based on the following formula:

$$M(i)=(1/N)\times\{M(i-1)\times(N-1)+X(i)\}$$

wherein 'N' denotes a sampling number of the image area ratios, 'M(i−1)' denotes a previously calculated moving average, and 'X(i)' denotes a most recent image area ratio detection result obtained by the information detection unit.

12. The image forming apparatus as claimed in claim 1, further comprising:

a toner supply unit that supplies toner to the developing apparatus; and a toner density detection unit that detects a toner density of the developer contained in the developing apparatus;

wherein the image density control unit includes a toner density control unit that controls toner supply operations of the toner supply unit based on a toner density control reference value that is used to control the toner density of the developer contained in the developing apparatus, said toner density control reference value corresponding to the image density control condition modified by the image density control condition modifying unit.

13. The image forming apparatus as claimed in claim 12, wherein the image density control condition modifying unit modifies the toner density control reference value so that the toner density decreases when the amount of toner exchanged at the developing apparatus is greater than a predetermined reference amount and modifies the toner density control reference value so that the toner density increases when the amount of toner exchanged at the developing apparatus is less than the reference amount.

14. The image forming apparatus as claimed in claim 1, wherein when the amount of toner exchanged at the developing apparatus within the predetermined period is greater than a predetermined first threshold value or is less than a predetermined second threshold value, a process execution interval of the parameter modifying unit is controlled to be shorter than a case in which the amount of toner exchanged at the developing apparatus within the predetermined period is less than or equal to the predetermined first threshold value and is greater than or equal to the predetermined second threshold value.

15. An image density control method implemented in an image forming apparatus including an image carrier that supports a latent image, a latent image forming unit that forms the latent image on the image carrier, a developing apparatus that develops the latent image formed on the latent image carrier into a toner image using a developer including toner and a magnetic carrier, and a belt member that is arranged to be in contact with the image carrier and is suspended in a tensioned state by a plurality of support members, the method comprising the steps of:

modifying an image density control condition based on information for determining an amount of toner exchanged at the developing apparatus within a predetermined period and a parameter that is adjustably set according to a detection result obtained by detecting a toner pattern that is formed on the belt member; and controlling an image density of an output image based on the modified image density control condition, the method further comprising detecting image area ratios of a plurality of images formed within the predetermined period, wherein the controlling includes controlling the image density using the image area ratios which have been detected, and wherein the modifying calculates the modified image density control condition based on a moving average of the image area ratios which have been detected.

16. The image forming apparatus as claimed in claim 1, wherein the information detection unit is configured to detect a size of the toner pattern for determining the amount of toner exchanged between the developing apparatus and the image carrier within the predetermined period.

17. The image forming apparatus as claimed in claim 1, wherein:

the parameter modifying unit modifies the parameter to decrease a toner density, and a slope of a relational expression representing a toner adhering amount in relation to a developing potential is decreased so that the image density may be maintained at a fixed level, when the information detection unit detects an image ratio greater than 5%, and the parameter modifying unit modifies the parameter to increase the toner density, when the information detection unit detects an image ratio less than or equal to 5%.

18. The method according to claim 15, further comprising:

detecting a size of a toner pattern for determining an amount of toner exchanged between the developing apparatus and image carrier within a predetermined period.

19. The method according to claim 15, further comprising:

modifying a parameter to decrease a toner density, and decreasing a slope of a relational expression representing a toner adhering amount in relation to a developing potential so that the image density may be maintained at a fixed level, when an image ratio is greater than 5%, and modifying a parameter to increase the toner density, when the image ratio is less than or equal to 5%.

* * * * *